US006962260B2

(12) United States Patent
Jay et al.

(10) Patent No.: US 6,962,260 B2
(45) Date of Patent: Nov. 8, 2005

(54) DEPTH AND WIDTH ADJUSTABLE DISPLAY TRACK UNIT WITH REMOVABLE PARTITIONS

(75) Inventors: Richard Jay, Westport, CT (US); Martin L. Illers, Yonkers, NY (US); Peter Hanretty, Port Chester, NY (US); Albert Menz, New York, NY (US)

(73) Assignee: Display Technologies, LLC, College Point, NY (US)

( * ) Notice: Subject to any disclaimer, the term of this patent is extended or adjusted under 35 U.S.C. 154(b) by 0 days.

(21) Appl. No.: 10/112,659

(22) Filed: Mar. 30, 2002

(65) Prior Publication Data

US 2003/0132178 A1 Jul. 17, 2003

Related U.S. Application Data

(63) Continuation-in-part of application No. 10/043,844, filed on Jan. 14, 2002, now Pat. No. 6,874,646.

(51) Int. Cl.[7] ..... A47F 1/04
(52) U.S. Cl. ..... 211/59.2
(58) Field of Search ..... 211/59.2, 59.3, 211/74, 184, 51, 93; 312/183, 71, 82, 85

(56) References Cited

U.S. PATENT DOCUMENTS

| | | | | |
|---|---|---|---|---|
| 2,309,896 A | | 2/1943 | Gustafson et al. | |
| 2,845,188 A | | 7/1958 | Rosenquist et al. | |
| 3,954,184 A | * | 5/1976 | Mendenhall | 211/184 |
| 4,191,299 A | * | 3/1980 | Moore | 211/184 |
| 4,448,314 A | * | 5/1984 | Weiller | 211/131.1 |
| 4,595,105 A | * | 6/1986 | Gold | 211/43 |
| 4,651,883 A | * | 3/1987 | Gullett et al. | 211/59.2 |
| 4,712,694 A | | 12/1987 | Breslow | |
| 4,768,660 A | | 9/1988 | Handler et al. | |
| 4,768,661 A | * | 9/1988 | Pfeifer | 211/184 |
| 4,785,945 A | * | 11/1988 | Rowse et al. | 211/59.2 |
| 4,858,774 A | | 8/1989 | Winter et al. | |
| 5,024,336 A | * | 6/1991 | Spamer | 211/59.2 |
| 5,199,584 A | | 4/1993 | Fowler et al. | |
| 5,240,126 A | | 8/1993 | Foster et al. | |
| 5,255,802 A | * | 10/1993 | Krinke et al. | 211/184 |

(Continued)

FOREIGN PATENT DOCUMENTS

WO WO 01/41603 A1 6/2001

OTHER PUBLICATIONS

U.S. Appl. No. 10/043,844 filed Jan. 14, 2002 of which the present application U.S. Appl. No. 10/112,659 is a continuation–in–part.

*Primary Examiner*—Hugh B. Thompson, II
(74) *Attorney, Agent, or Firm*—Amster, Rothstein & Ebenstein

(57) ABSTRACT

An integrally molded display floor for a gravity feed display tray where the floor devoid of integrally molded side walls extending upward therefrom, has front and rear end walls, and a plurality of longitudinal ribs which can receive upward extending partitions which are releasably attachable to the floor and extend longitudinally, thus dividing the display tray into laterally spaced paths. Each display tray has opposite side walls extending downward, and transversely extending beams intersecting the longitudinal ribs. The end walls, side walls, and bottom surfaces of the longitudinal ribs thus establishing a basement where the bottom surfaces of the ribs constitute the ceiling of the basement. This basement is a space suitable for receiving downward extending tabs of the partitions to engage and stabilize such partitions with the display track. The basement also provides suitable space for lateral extending coupling means from one display track to the next for coupling adjacent display tracks to provide a wider transverse area thereof. Furthermore, the basement allows space for further coupling members extending from the rear end of any display track element to the front end of the next for coupling thereto.

49 Claims, 21 Drawing Sheets

U.S. PATENT DOCUMENTS

D341,967 S * 12/1993 Cohn ..... D6/511
5,351,740 A 10/1994 Hanna
5,457,859 A 10/1995 Kacprowicz
5,624,042 A 4/1997 Flumm et al.
5,645,176 A * 7/1997 Jay ..... 211/59.2
5,682,824 A 11/1997 Visk
5,685,664 A * 11/1997 Parham et al. ..... 403/393
5,695,076 A * 12/1997 Jay ..... 211/59.2
5,695,077 A * 12/1997 Jay ..... 211/59.2
5,709,158 A * 1/1998 Wareheim ..... 108/186
6,082,558 A * 7/2000 Battaglia ..... 211/59.3
6,129,218 A * 10/2000 Henry et al. ..... 211/59.3
6,234,328 B1 5/2001 Mason
6,402,106 B1 6/2002 Padiak
6,523,703 B1 * 2/2003 Robertson ..... 211/59.3

* cited by examiner

FIG. 11
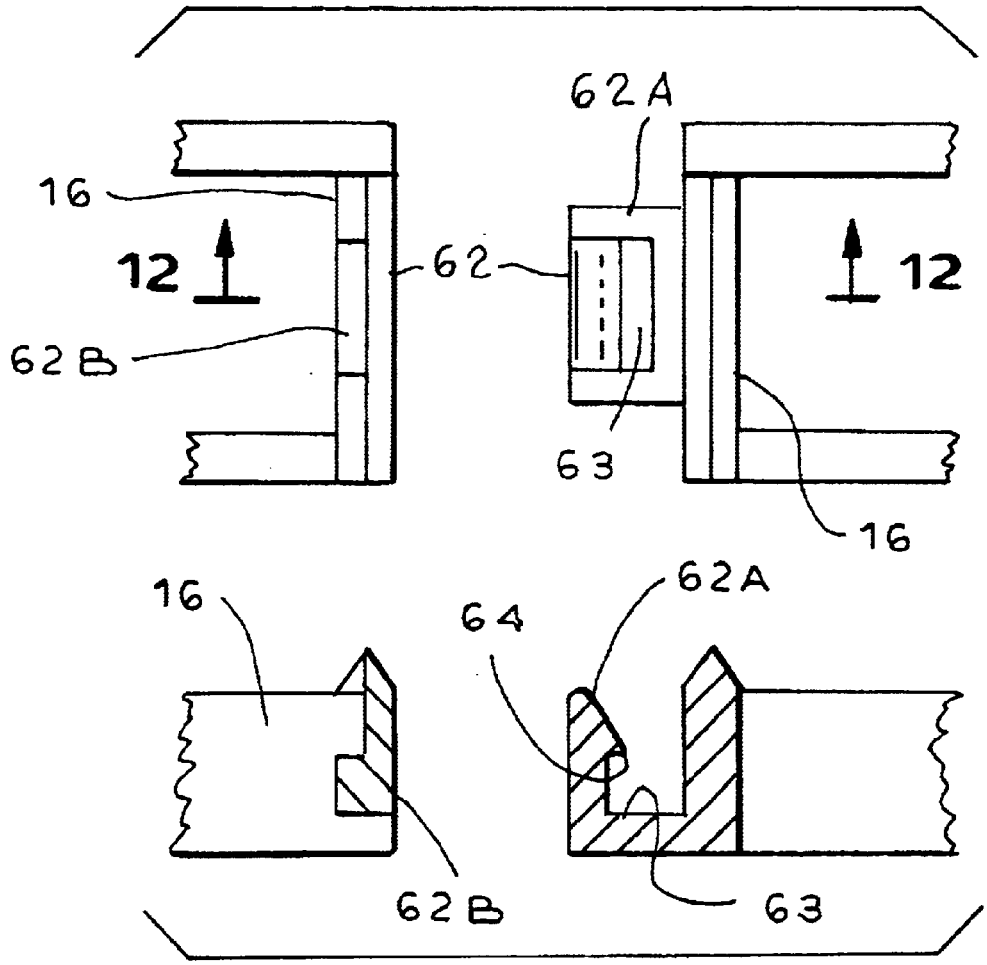
FIG. 12
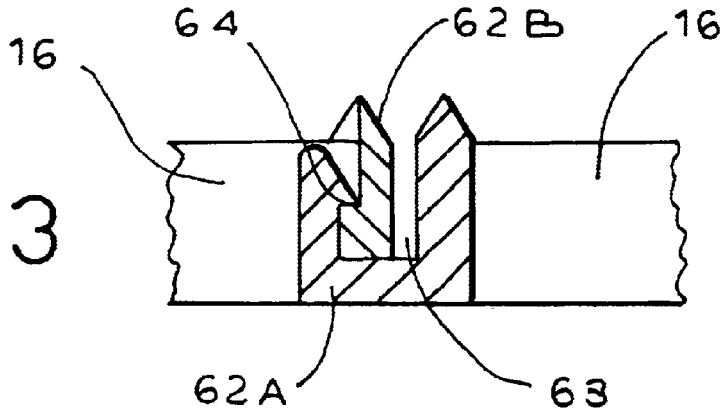
FIG. 13

82
92D
92
97
92B
92C'
100
L
98
92C
104
92A
99A
105
99B
119
121A
120A
121B
120B
121C
120C
121D
120D 86
72
76F
94
95
240
92B
200
32
220
92C
92
210
230

92
210
230
200
220
240

DEPTH AND WIDTH ADJUSTABLE DISPLAY TRACK UNIT WITH REMOVABLE PARTITIONS

RELATED PATENTS

This application is a continuation-in-part of application having U.S. Ser. No. 10/043,844 filed Jan. 14, 2002, now U.S. Pat. No. 6,874,646.

BACKGROUND OF THE INVENTION

The present invention relates to a display track, and more particularly to a depth and width adjustable track unit with removable partitions.

Display shelves are commonly found in stores, supermarkets, and the like for the display of products available for sale. The display shelf may be flat, in which case there is typically a spring-loaded pusher unit to push the displayed products forward as each foremost product is purchased and removed, or inclined, in which case, as each foremost product is removed, the remainder of the products move forwardly under the influence of gravity (such shelves typically being known as "gravity-feed shelves"). Depending upon the type of products to be displayed, the display shelf maybe disposed on a counter or table top (for example, where the products for display are batteries, film, or other dry, canned, boxed or bagged food and consumer products commonly sold at room temperature) or on a supporting tray in a refrigeration unit (for example, where the products are bottles or cans of beer, soda, milk or other products commonly sold chilled). The display shelf may consist of a single track or channel but more commonly consists of a plurality of such tracks disposed side-by-side in either a fixed or releasable relationship.

From the point of view of the retailer, the display shelf should be of sufficient depth (that is, the length from the front thereof to the back thereof) that the entire depth of the support surface (i.e., the counter, table top or refrigeration tray) is occupied by the shelf-that is, so that there is no wasted space. If the display shelf does not occupy the full depth, objects placed on the support surface in front of the display shelf will conceal the products intended to be displayed on the display shelf, while objects placed on the support surface behind the display shelf will be at least partially hidden from customer view and not readily accessible to a potential customer. This problem has been addressed in the past by providing a "standard depth" shelf which has breakaway rear portions enabling the depth of the display shelf to be shortened to meet the available space. An obvious disadvantage of this solution to the problem is that some counters, tabletops or refrigeration trays will be deeper than the "standard depth" display shelves.

Another solution to this problem is to provide the retailer with a "standard depth" display shelf and add-on sections. The add-on sections may be "added on" to the back of the display shelf (assuming that the display shelf does not have a back wall which would interfere with the passage of products from the add-on sections to the main display shelf). Alternatively, where the front and back sections of the display shelf may be separated (e.g., broken-away), the add-on sections may be inserted between the separated front and back sections of the display shelf.

The "add-on sections" solution is not favored, however, either by the retailer or the display shelf manufacturer. Typically additional members—e.g., fasteners or connecters—must be used to connect the add-on sections either to the back section of the display shelf or to the front of the back section and the back of the front section of the display shelf. Such connecters are typically relatively small and easy to lose during the assembly process. From the point of view of the manufacturer of the display shelf, the add-on sections solution is particularly onerous because the manufacturer must not only purchase, maintain and operate the usual molds for the production of the standard depth display shelf, but also a special mold for the production of the add-on sections. The add-on sections solution further entails logistical problems in that a separate inventory of the add-on sections must be maintained by the manufacturer, made available for purchase, and delivered to purchasers. In brief, the manufacturer must manufacture, sell and deliver two products—that is, the standard depth display shelf and the add-on sections—rather than merely one product (that is, the standard depth display shelf).

As a practical matter, the dilemma of the producer is even greater since the customer may desire add-on sections of different depths so that the customer can make full use of the available depths of a variety of different-depth support surfaces. Each of these add-on sections of differing depth then becomes yet another product line to be manufactured, sold and delivered by the manufacturer.

For the various racks, whether enlarged or reduced in the length and width dimensions, it is typical to utilize a plurality longitudinally extending partition which may be installed in selected locations to accommodate products of various widths. It is important to provide removable partitions extending lengthwise on the display tracks which partitions need to be easily installed and easily removed and easily changed in length to match the shape and space in the gondola display case.

Further problems with partitions are that products divided by the partitions nevertheless tend to topple off the front of the display track or in display cabinets with front doors, to slide too far and lie against the front door and then fall out when the door is open. Also these partitions become dislodged because customers pull on products or pull on the partitions themselves when products become wedged between them.

A further factor is economy of space. Space is at a premium and it is desirable to have the absolute maximum amount of lateral and depth space and also height. Therefore, the partitions need to be coupled to the tracks while utilizing a minimum of depth of the track.

Typical prior art partitions have included numerous structural and functional features which inhibit their usefulness. This usually occurs when achieving one objective necessitates sacrifice or compromises another. For example, ease of installation and removal often results in partitions that are easily dislodged or are unstable against topping forces. Conversely, highly secure and stable partitions are often quite cumbersome to install and remove. Efforts to solve these problems have been hindered by various factors inherent in the industry, including the need to maximize display space, and to incorporate maximum flexibility to enlarge or reduce display rack dimensions, and to render these products so user friendly that minimum training is required for installation and adjustment.

It is an objective for these partitions to be easily installable and removable, and to be resistant to dislodgment or tipping, and to be adjustable in length to correspond to the length selected for the display rack.

It is a further objective to have the new improvements applicable to various known display track structures, and particularly to the display track as disclosed in the parent application of the present continuation-in-part application.

It is still further objective to design partitions which are readily installed, are highly resistant to tipping, shifting or otherwise being dislodged while installed and are readily removable without special skills or equipment.

Another object is to provide releasably locking or safety coupling means so that these partitions cannot be accidentally dislodged by customers when they take displayed products or by store operators when they install or adjust these display locks.

A further object is to provide a front lip onto the display track to prevent forward toppling of products.

A still further object is to utilize existing structure of adjacent longitudinal support bars of triangular cross-sections to cooperate with partitions to result in easy releasable connectability and stability.

Accordingly, it is an object of the present invention to provide a depth-extendable display track unit enabling a customer to form a depth-extended display track.

Another object is to provide such a unit which in one preferred embodiment consists of at least two essentially identical standard depth display tracks.

A further object is to provide such a unit which in one preferred embodiment does not require the manufacturer to manufacture, sell or deliver add-on sections to enable formation of the depth-extended display track.

It is also an object of the present invention to provide such a unit wherein in one preferred embodiment depth extension is achievable without the use of additional components such as fasteners.

It is a further object to provide such a unit which is simple and inexpensive to manufacture and use.

SUMMARY OF THE INVENTION

It has now been found that the above and related objects of the present invention are obtained in a depth-extendable and/or width extendible display track unit which is adapted to receive one or more partitions with new coupling elements for releasable attachment to the display track which has corresponding structure to receive the partition coupling elements and to receive other releasable coupling elements for longitudinal or depth and transverse or width dimensional changes in the basic display track unit. The depth-extendable display track unit consists of at least two essentially identical standard depth display tracks for forming a single depth-extended display track from one of the standard depth display tracks and at least one section of another of the standard depth display tracks. Each of the essentially identical standard depth display tracks comprises a front section, a breakaway back section with rear engagement means at the rear thereof, and an interconnected series of breakaway intermediate sections connecting the front and back sections. The intermediate and back sections define at the front of each such section forward engagement means for engagement with the rear engagement means at the rear of the back section, the forward engagement means being exposed for engagement by breaking away of the immediately forward section.

In a preferred embodiment, in each of the essentially identical standard depth display tracks, the rear engagement means projects rearwardly from the back section, and the forward engagement means is configured and dimensioned to receive therein the rear engagement means. Preferably the forward engagement means is female in nature, the rear engagement means is male in nature, and the forward and rear engagement means cooperatively form a male/female engagement. Preferably the forward and rear engagement means are disposed below the level of an article-supporting surface of the intermediate and back sections.

Optionally the front section defines at the front thereof stop means for limiting forward movement of articles on the standard depth display track.

In each of the essentially identical standard depth display tracks, at least one of the intermediate sections preferably differs in depth from at least one other of the intermediate sections.

This new invention provides an integrally molded display track unit for a gravity feed display tray where the floor surface of each track unit has no upstanding side walls but is adapted to hold removable partitions. These partitions are releasably engageable to the display track by virtue of having coupling fingers that extend below the top surface of the display tray. The top surface is defined by a plurality of laterally spaced apart longitudinal ribs whose top surfaces define the product support surface and whose bottom surfaces define the ceiling of a basement space, this space being further defined by longitudinal side walls and transverse front and rear walls. Extending transversely of said longitudinal ribs is a plurality of transverse beams spaced apart in said longitudinal direction. All these rib, beam and wall components comprise an integrally formed injection molded display track unit.

This basement comprises structure and space to receive positioning and releasable locking tabs or fingers that extend from the partitions downward between pairs of adjacent ribs and engage basement structure below the ceiling. In some embodiments, the downward extending fingers from the partitions engage the bottom surfaces of transverse beams; in other embodiments these fingers engage the bottom surfaces of the longitudinal ribs. In all these embodiments the fingers cooperate with the basement structure to help position, stabilize and secure the partitions with respect to the display tracks, and particularly to prevent partitions from being lifted or otherwise unintentionally displaced from their proper position. The basement further provides structure to engage the various coupling elements for joining display track segments to extend in the longitudinal and/or transverse direction.

It is a further object of this invention to provide on the bottom of each partition a plurality and darts or arrow shaped coupling means which extend downward between adjacent longitudinal ribs in the display track for releasably coupling thereto. In a preferred embodiment these downward extending coupling means extending alternatively left and right and are resilient for easier installation and removal.

A further object of the invention is to provide stop means of various heights at the front of certain partitions to bar packages from falling off the front edge. Such stop means may be in the form of: (a) a transverse strip or plate which extends across the entire front of the display track unit and extends upward from the top surface of the track, or (b) a narrow wall segment extending upward to an elevation higher than said transverse strip and extending only a short distance on one side of the partition or on both sides, the latter called a cathedral configuration.

A further object of this invention is to provide additional support and strengthening means for the plurality of display tracks which are coupled together in a transverse direction. This strengthening is provided by a transverse beam extending across and snugly engaging the front walls of all of the display track segments that are joined together side-by-side. A variation of this beam not only traverses and engages all the front walls of the joined display track units, but extends upward and is called lip extender to serve the additional function of stopping articles from falling off the front.

Another object of the invention is to include with the releasable coupling element for the partition, a trigger formed as a resilient portion of the partition itself. Pulling the trigger releases a finger from its engagement with a mating part of the display track. Preferably such mating part would be a portion of a transverse beam in the structure thereof.

A still further object of this invention to arrange for the partition to be stabilized in its desired location by having a plurality of longitudinally spaced fingers each extending forward so that the partition, when installed and slid forward, cannot be displaced upward by accident unless and until the user releases the coupling and pushes the partition rearward to disengage the forward directed fingers. Here a trigger release will allow the partition to be slid rearward and then lifted upward.

An additional object of this invention to provide below the display track a basement area which provides space for all the coupling means of the partitions and for lateral connection and lengthwise connection means of the respective display track components. Such basement will provide a strong structure to support a front lip molded integrally with the display track.

A further object of this invention it to configure the longitudinal ribs to have triangular cross-section where the apex of the triangle faces upward and where the adjacent sides of adjacent ribs define a generally triangular space pointing downward. The bottom portion of the partition has a downward pointing triangular shape whose sides engage the spaced apart sloping sides of the two triangular ribs. The ribs thus support the partition from extending farther downward and also stabilize it from tilting or rocking while it is coupled to these longitudinal ribs. Coupling is enhanced by a tooth surface or tab which is cammed transversely as the partition is pressed downward, until it snaps under one of the longitudinal ribs. It is subsequently releasable by tilting and pulling of the partition upward.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIGS. 11, 12 and 13 are fragmentary views, to a further enlarged scale, of the bracketed segment of FIG. 6 showing the lateral connecting means, FIGS. 11 and 12 being fragmentary top plan and sectional side elevational views, respectively, of the lateral connecting means prior to connection and FIG. 13 being a fragmentary sectional side elevational view showing the lateral connection means after connection;

DETAILED DESCRIPTION OF THE PREFERRED EMBODIMENTS

While the present invention will be illustrated and described herein in the context of a display shelf consisting of a single display track, it will be apparent to those skilled in the art that the same principles may be applied to any display shelf, whether it contains only one or a plurality of display tracks.

Figure 1:
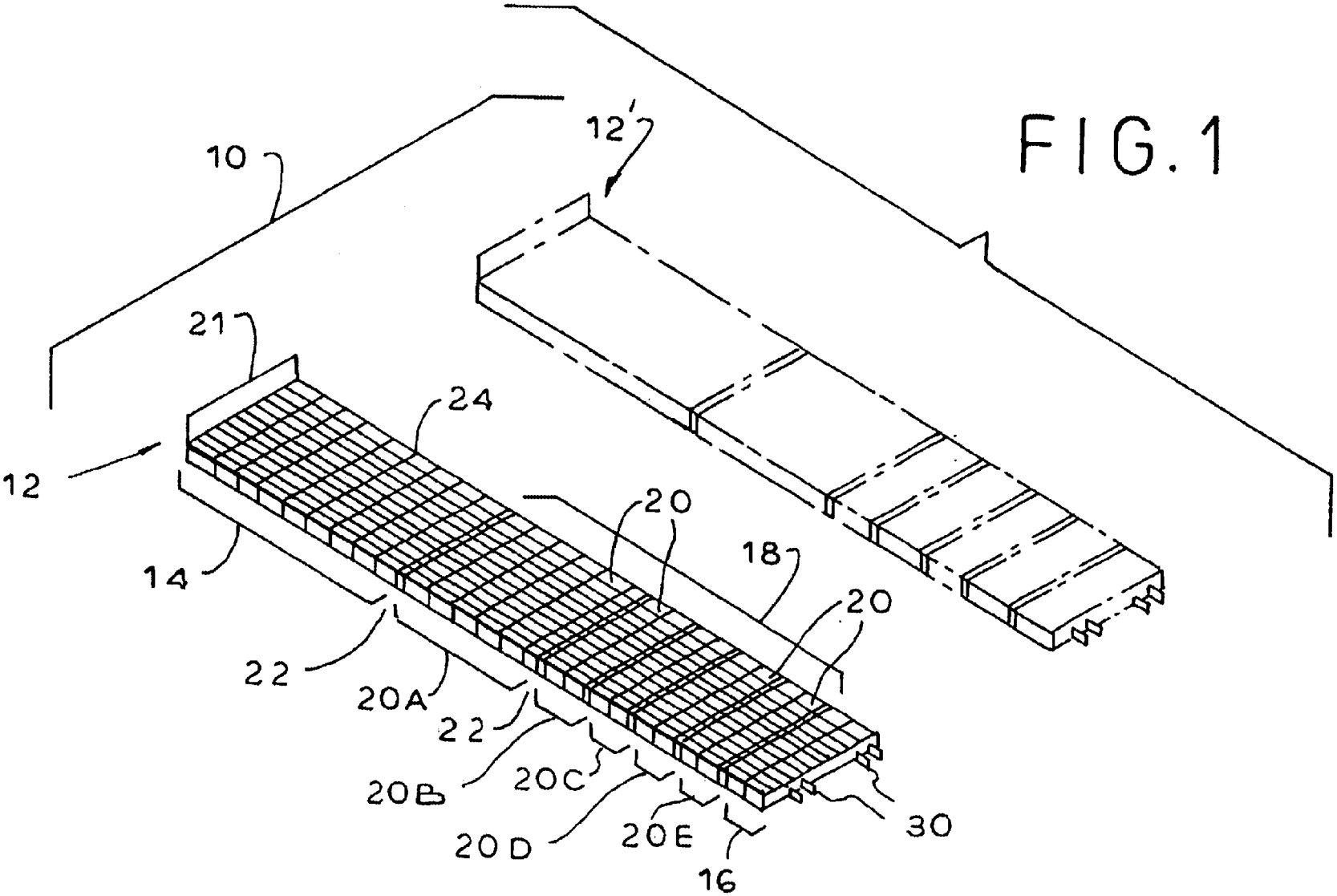
FIG. 1 is an isometric schematic view of a depth-extendable display track unit according to the present invention, including two standard depth display tracks.
Figure 2:
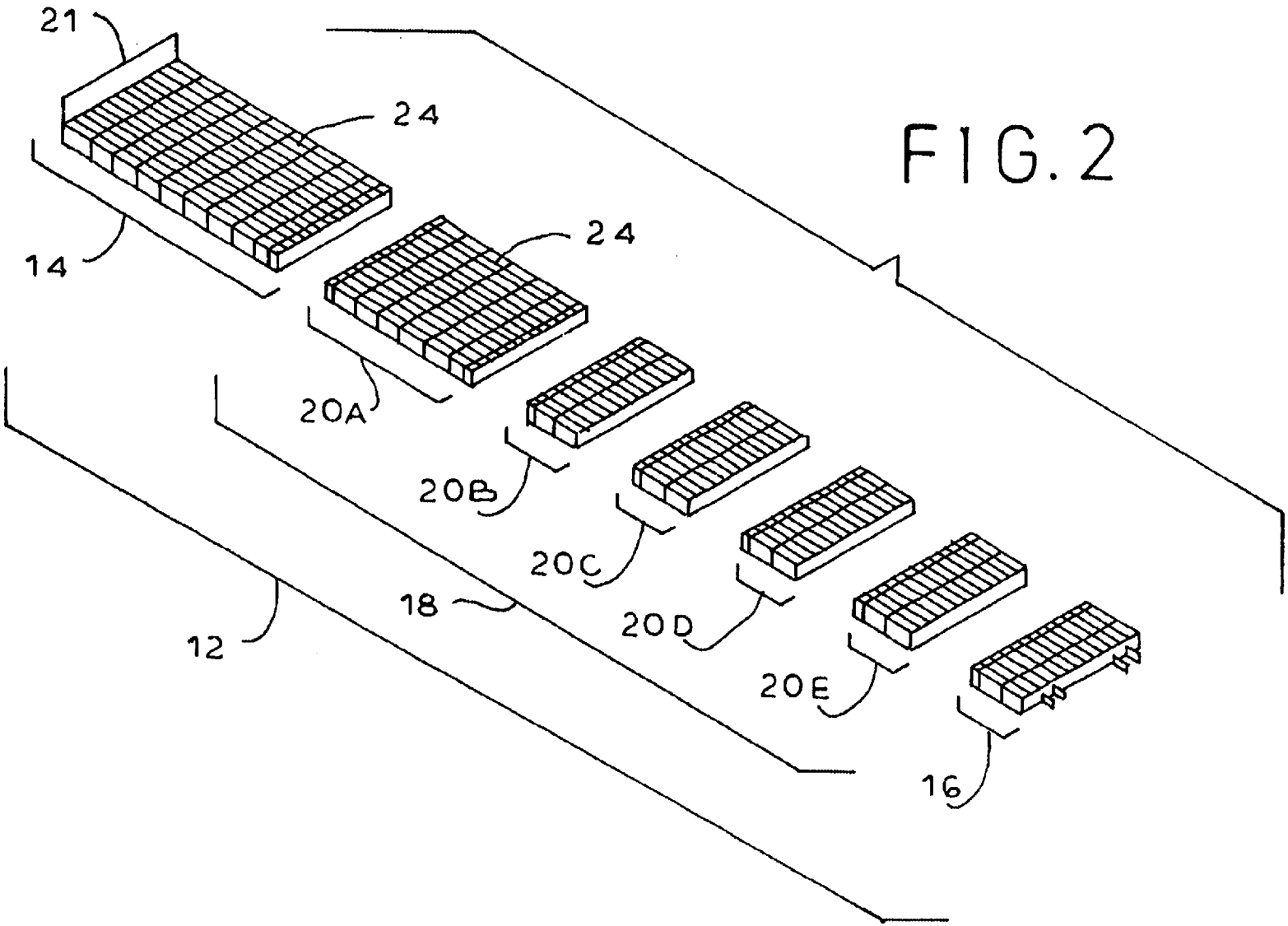
FIG. 2 is an exploded isometric view of one of the two standard depth display tracks of the unit.

Referring now to the drawing, and in particular FIG. 1 thereof, therein illustrated is a depth-extendable display track unit according to the present invention, generally designated by the reference numeral 10. The unit 10 consists of at least two essentially identical standard depth display tracks, generally designated 12, 12'. The display tracks 12, 12' are essentially identical in that they are formed in essentially identical molds and preferably have essentially identical surface ornamentation applied thereto. The display tracks may be purchased as a kit consisting of at least two such tracks 12, 12' to form the unit 10, or each track 12, 12' may be purchased separately and independently of one another but then cooperatively used as indicated herein below, just as if they had been purchased as a unit 10. Of course, each display track 12, 12' may be used separately and independently from the others as a standard depth display track.

As the tracks 12, 12' are identical, the detailed description of track 12 herein below will also serve as a detail explanation of the track 12'. Similar elements of the tracks 12, 12' will be identified by the same reference numeral, but with the elements of track 12' being primed.

Referring now in particular to FIGS. 2 and 4–6, each of the essentially identical standard depth display tracks 12 comprises a front section 14, a back section 16 and an interconnected series 18 of intermediate sections 20, the interconnected series 18 serving to connect the front and back sections 14, 16. As illustrated, the interconnected series 18 contains some five intermediate sections 20 identified as 20A through 20E.

The front section 14 is of conventional design and, especially in a gravity-feed display, will include stop means for limiting forward movement of articles on the track 12, typically an upstanding lip 21 restraining the forward movement of the lead article in a series of articles. The back section 16 has a conventional breakaway feature which enables the retailer to separate the back section 16 from the immediately forward section which, in the present instance, would be the last intermediate section 20E of the interconnected series 18. The breakaway feature is typically implemented by providing a plane of weakness 22 extending through the track 12 transverse to the major longitudinal dimension of the track. Thus a horizontal line of weakness 22 extends not only across the floor 24 of the track which supports the articles to be displayed, but also through the entire height of any sidewalls 26 on either side of the floor 24. Thus the plane of weakness 22 extending through the floor 24 and sidewalls 26 enables the back section 16 to be easily and conveniently intentionally removed from the remainder of the track 12. This breakaway back feature is conventional in nature and hence need not be described herein in further detail. The breakaway feature is conventionally used to enable the conventional standard depth display track to be used in situations where there is only limited depth available.

The interconnected series 18 of intermediate sections 20 connecting the front and back sections 14, 16 is also characterized by a breakaway feature allowing each intermediate section 20 to be broken-away, either individually and successively or as one or more groups of intermediate sections 20, where a further depth reduction is required above and beyond that provided by removal of the back section 16 alone.

Figure 4:
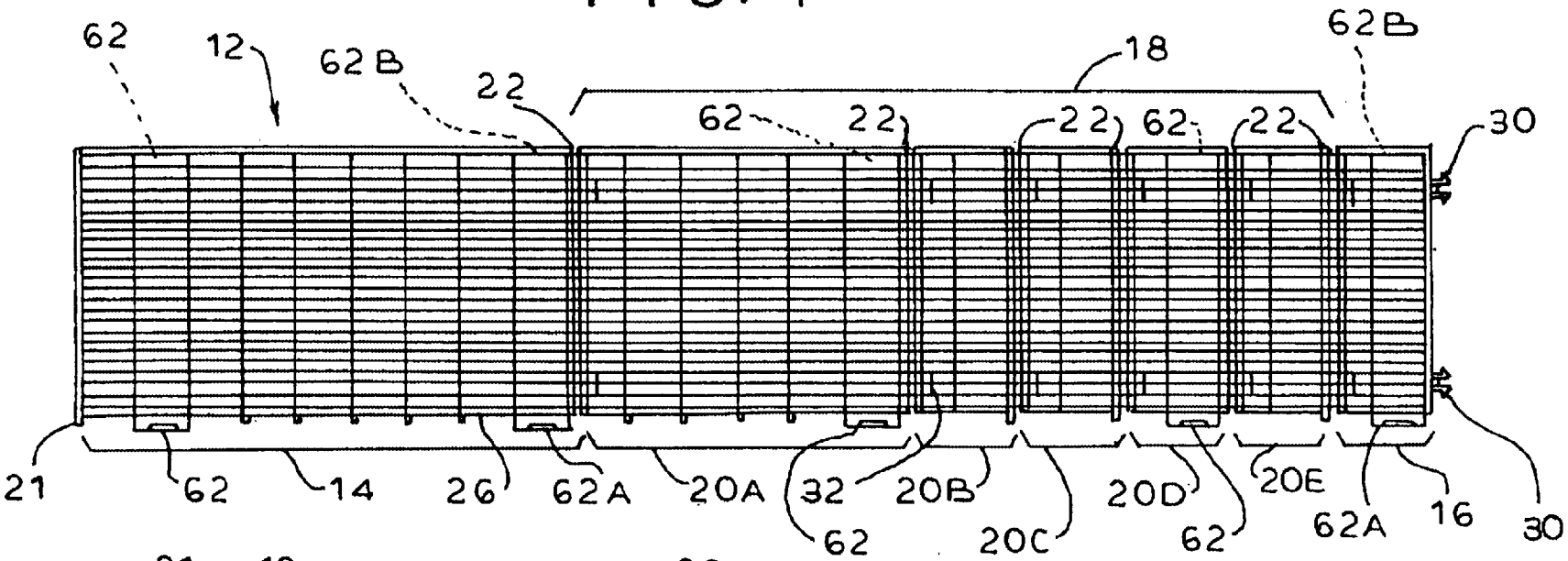
FIG. 4 is a top plan semi-schematic view, to an enlarged scale, of a standard depth display track of the unit.
Figure 5:
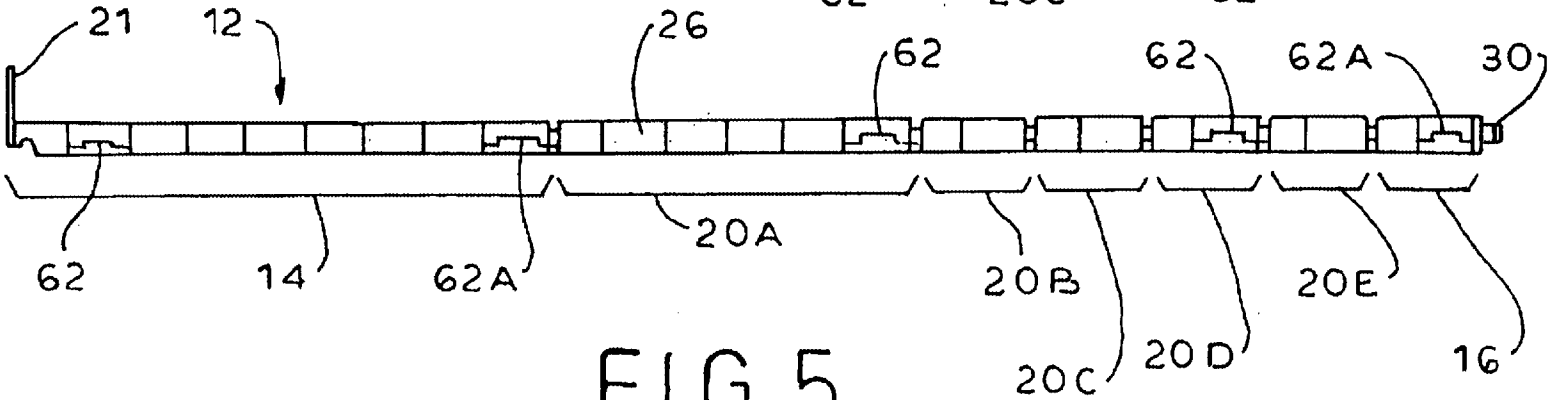
FIG. 5 is a side elevational semi-schematic view, to an enlarged scale, thereof.
Figure 6:
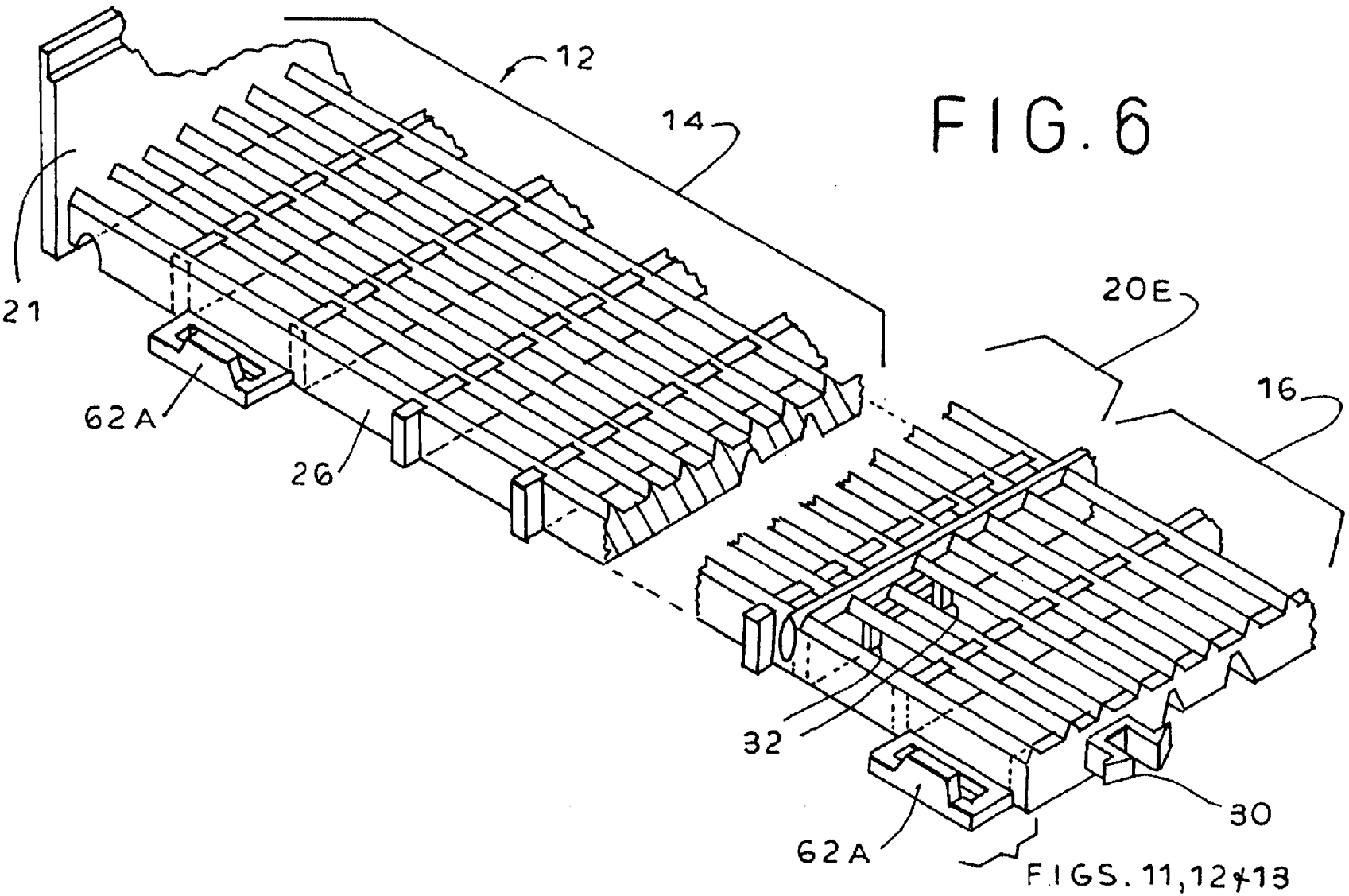
FIG. 6 is a fragmentary isometric view, to a greatly enlarged scale, of a portion of a standard depth display track of the unit.
Figure 7:
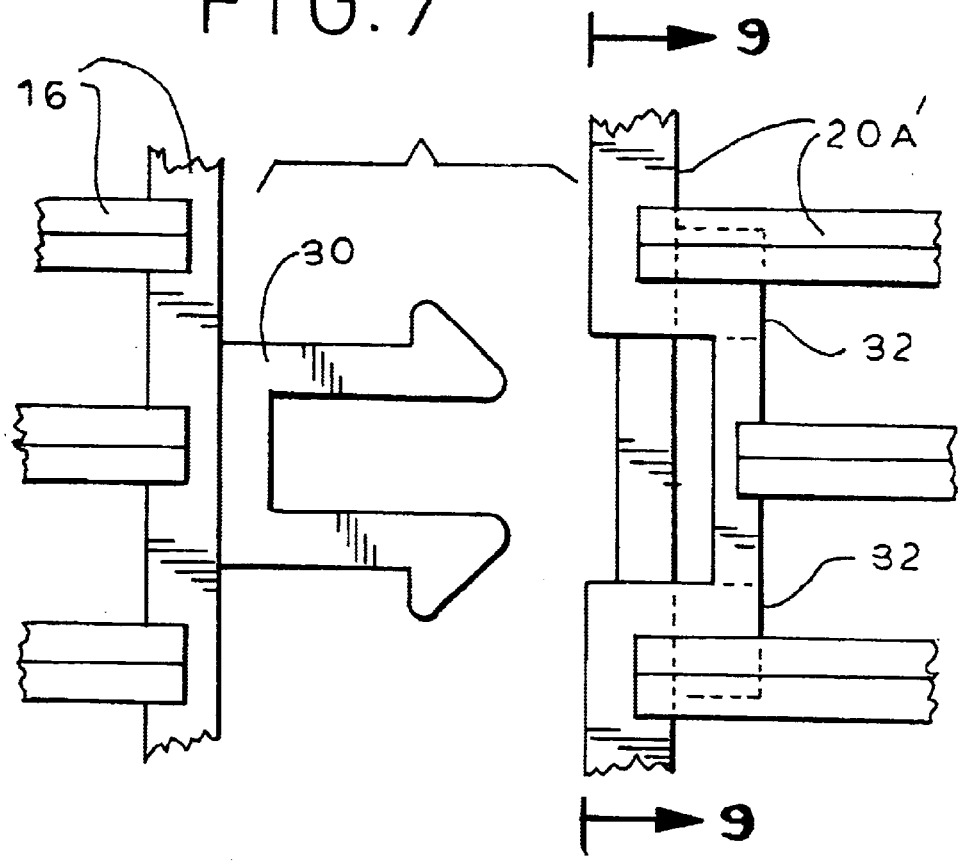
FIGS. 7 and 8 are fragmentary views, to a further enlarged scale, of the bracketed segment of FIG. 3 (identified by the designations of FIGS. 7 and 8) showing the rear and front engagement means in a separated relationship in FIG. 7 and in an engaged relationship in FIG. 8.
Figure 8:
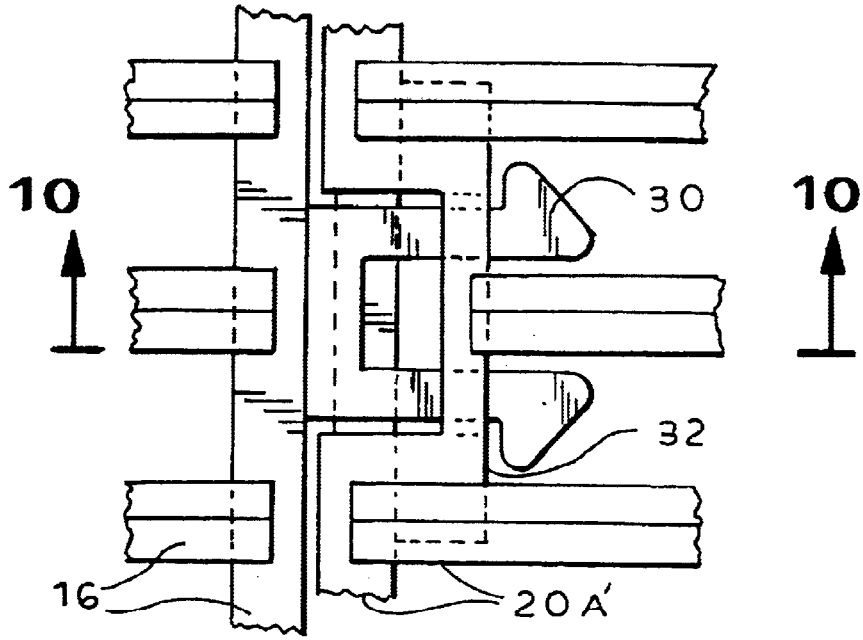
Figure 9:
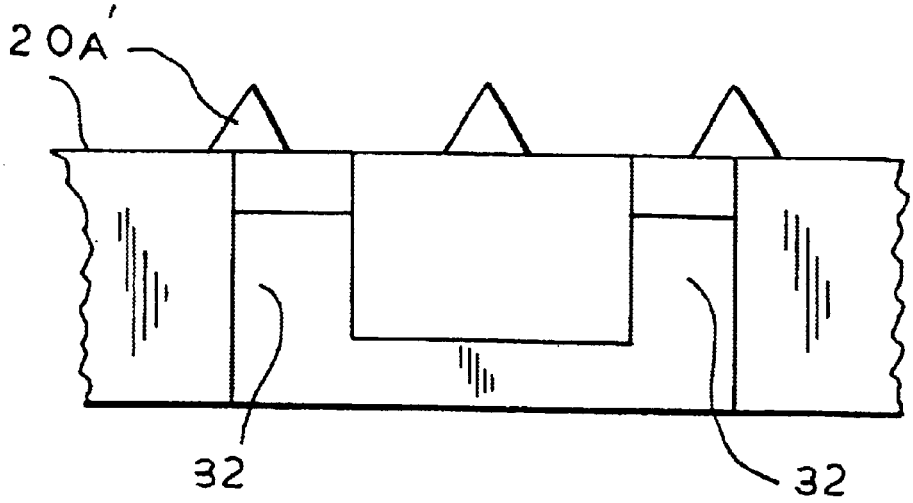
FIGS. 9 and 10 are sectional views taken along the lines 9—9 of FIGS. 7 and 10—10 of FIG. 8, respectively.
Figure 10:
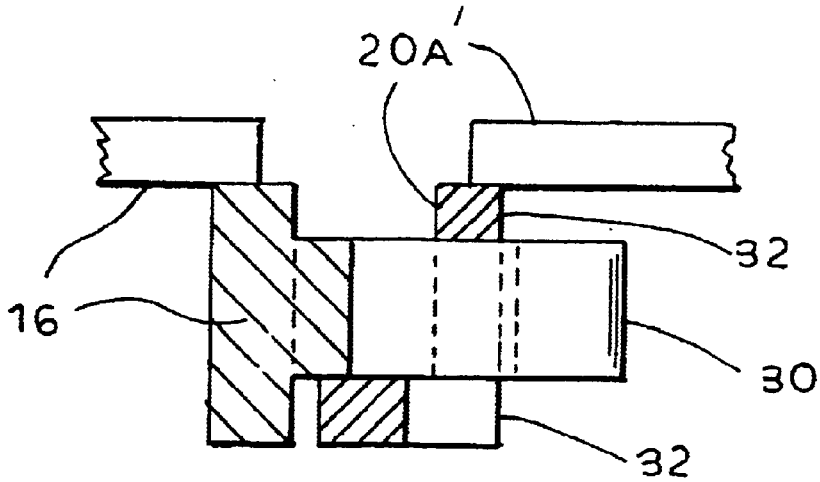

A display tray may consist of a single track 12, just wide enough to accommodate a single lane or channel of product to be displayed, or a plurality of such tracks 12 disposed side-by-side. In the latter instance, each sidewall 26 of a track 12 is provided with lateral connecting means 62 to facilitate joinder of the side-by-side tracks 12, preferably in a releasable manner. Preferably, as illustrated in FIGS. 4–6, the front and back sections 14, 16, the first intermediate section 20A (that is, the intermediate section of greatest length), and at least one or more of the remaining intermediate sections 20B–20E is also provided with connecting means 62. Means for connecting display tracks in side-by-side relationship are well-known in the art and hence, need not be described herein in further detail.

Turning now to the novel aspects of the present invention, and referring now as well to FIGS. 6 through 10, the back section 16 is provided at the rear thereof with rear engagement means 30, and each of the intermediate and back sections 20, 16 defines at the front of each such section 20, 16 forward engagement means 32. The rear engagement means 30 projects rearwardly from the back section 16, and the forward engagement means 32 is disposed at the front of each such section 20,16. Preferably the rear engagement means 30 is male in nature, while the forward engagement means 32 is female in nature, the rear and forward engagement means 30, 32 thus being capable of forming a secure male/female engagement. The forward engagement means 32 is typically configured and dimensioned as a channel with a front constriction designed to receive there through and retain therein the two divergently biased barbs of the rear engagement means 30.

Preferably the rear and forward engagement means 30, 32 are both disposed below the level of the article-supporting floor 24 of the intermediate and back sections 20, 16. For example, the forward engagement means 32 may be a channel configured and dimensioned to receive the rear engagement means 30 and extending the full length of the track 12, or just the full length of the back and intermediate sections 16,20. Alternatively, as illustrated, the forward engagement means 32 need not extend the full length of either intermediate sections 20 or the back section 16 and may simply be disposed at the front of each intermediate section 20 and back section 16. While the rear engagement means 30 always projects rearwardly from the back section 16, available for engagement, the forward engagement means 32 of the back and intermediate sections 16, 20 must be exposed (before engagement by the rear engagement means 30) by breaking away of the immediately forward section thereto 0 (whether that be the front section 16 or an intermediate section 20).

Figure 3:
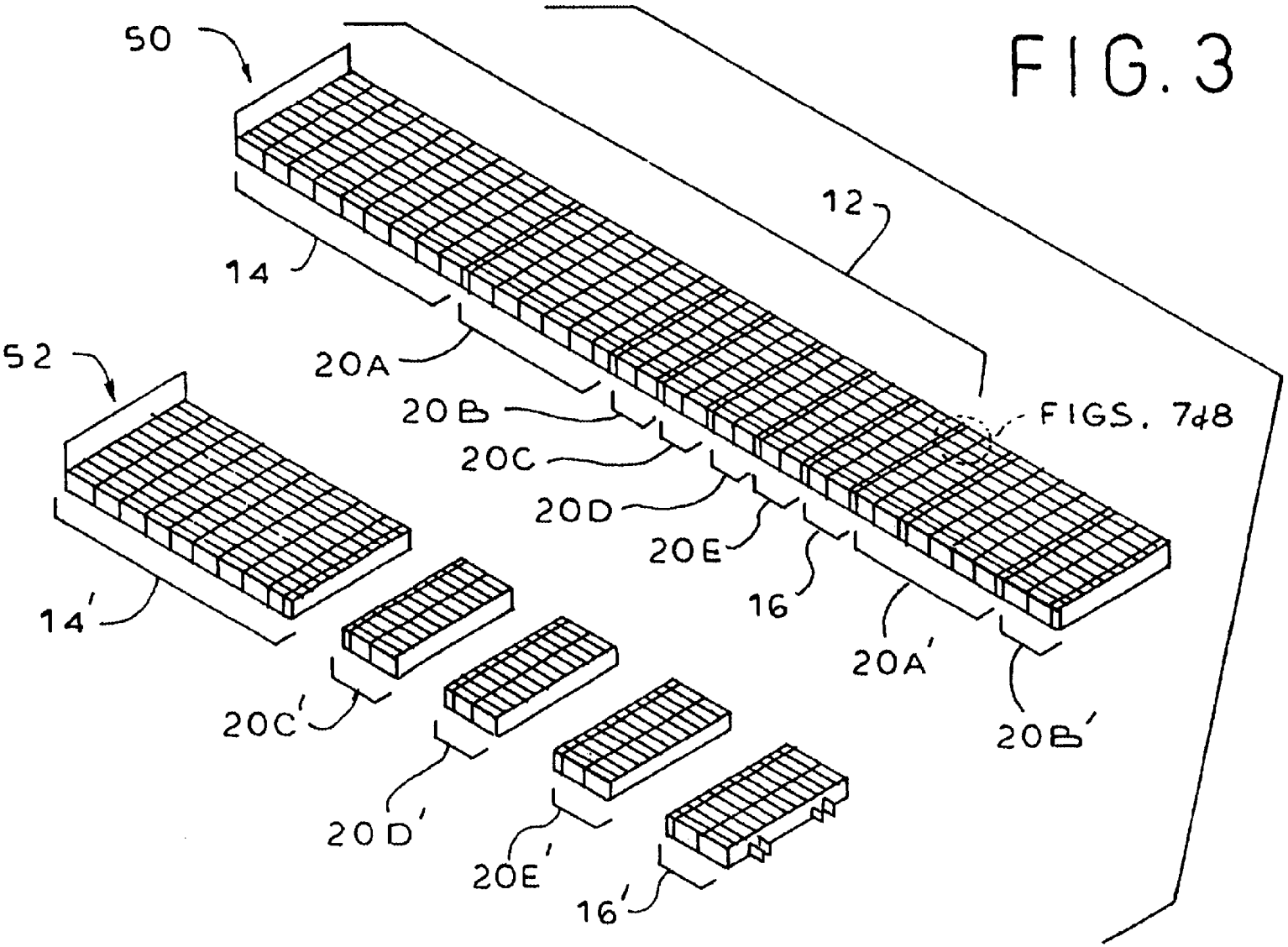
FIG. 3 is an isometric schematic view of a depth-extended display track formed from the unit of FIG. 1 and the left-over remnants of the unit.

Referring now to FIG. 3 in particular, therein illustrated is a depth-extended display track, generally designated 50, formed from a depth-extendable display track unit 10 according to the present invention. Also illustrated therein are the left-over remnants 52 of the second track 12' which has been sacrificed in order to provide the first track 12 with an extension of 8" by donating to the first track 12 two of its intermediate sections 20A' and 20B'. What remains as remnants 52 of the second track 12'—that is, the front section 14', intermediate sections 20C' through 20E'—and back section 16' may be discarded as waste.

Alternatively, the "waste" may be used in the formation of another depth-extended display track (not shown). Where the forward engagement means 32 also extends under the front section 14, the front section 14' of the second track 12' may also be used by itself (rotated 180°) in the formation of another depth-extended display track. Indeed, even where the forward engagement means 32 does not extend under the front section 14, the sub-assembly of the front section 14' and at least one intermediate section 20' left attached thereto may be used (rotated 180°) in the formation of another depth-extended display track.

Preferably, the front section 14 is of the greatest depth (for example, about 9") and the back section 16 is of the least depth (for example, about 2"), while individual ones of the intermediate sections 20 may range from about 2" to 6". The number of intermediate sections 20 in the series 18 may vary, but typically five are provided, initial section 20A being about 6" deep and the remaining sections 20B–20E each being about 2" deep. Thus, between the breakaway back section 16 and the breakaway intermediate sections 20, a standard depth display track 12 of 25" maybe reduced to 23" (by removal of aback section 16 of 2" alone), or to 21", 19", 17" or 15" (by further removal of one, two, three or four of the smaller intermediate sections 20 of 2" each) or to 9' (by removal as well of the large intermediate section 20A' of 6").

Thus, a depth-extended display track 50 may be made as deep as 41" and consist of one standard 25" depth track 12 plus one 6" intermediate section 20A' plus four 2" intermediate sections 20B'–20E' plus one 2" back section 16' from the other track 12'. Indeed, it is possible for a depth-extended display track 50 to be made as deep as 48" by including 14" from the intermediate sections 20' and 9" from the front section 14' (rotated 180°).

Further, if the rear engagement means 30 is itself of a breakaway design, a depth-extended display track 50 of 50" may be formed from two standard 25" depth display tracks 12, 12' by simply breaking away the rear engagement means 30' of the second track 12' and then connecting that second track (rotated 180°) to the rear engagement means 30 of the first track 12. Of course, in this instance, there is no waste whatsoever (except for the broken-away rear engagement means 30), but it does require that the forward engagement means 32 either extend the fill length of the back section 16 or at least be exposed at the back end thereof after the rear engagement means 30 is removed.

Similarly, if the front lip 21 acting as stop means is itself of a breakaway design, a depth-extend display track 50 of 50" may be formed from two standard 25" depth display tracks 12, 12' by simply breaking away the front lip 21' of the second track 12' and then connecting that second track (without rotation) to the rear engagement means 30 of the first track 12. Of course, in this instance, there is also no waste whatsoever (except for the broken-away front lip 21), but it does require that the forward engagement means 32 either extend the full length of the front section 14 or at least be at the exposed front end thereof after the front lip 21' is removed.

Preferably, as illustrated, at least one of the intermediate sections 20 (e.g., section 20A) differs in depth from at least one other of the intermediate sections 20 to enable fine tuning of the depth of the depth-extended display track 50.

While the sacrifice of one of the tracks 12 to enable the transformation of the other track 12 into the depth-extended track 50 may entail a certain amount of material waste, the economic savings effected by the manufacturer, who is now able to meet the needs of his customers without maintaining at least one independent "add-on section" production line, more that compensates the manufacturer. Further, the present invention places the cost of extending the standard depth display track precisely where it belongs—namely on the retailer who is seeking to maximize the utility of the available shelf-supporting surfaces in his establishment. In other words, the cost is allocated to the person who receives the benefits.

Referring now to FIGS. 4–6 and 11–13 in particular, therein illustrated are the improved lateral connecting means 62 of the present invention, comprising female lateral connecting means 62A and male lateral connecting means 62B. To engage the male and female lateral connecting means 62B, 62A, the male connecting means 62B is forced downwardly into the opening 63 of the female connecting means 62A. During insertion, the male connecting means 62B is cammed along the adjacent inclined surface of the female connecting means 62A until it snaps back underneath the camming surface ledge 64, where it is then held until forcible displacement. For expository purposes and clarity of illustration, lateral connecting means 62 are omitted from FIGS. 1–3.

To summarize, this first embodiment of the present invention provides a depth-extendable display track unit enabling a customer to form a depth-extended display track. The unit consists of at least two essentially identical standard depth display tracks and does not require the manufacturer to manufacture, sell or deliver add-on sections to enable formation of the depth-extended display track. Further, the depth-extended display track is achieved without the use of additional components such as fasteners. The unit is simple and inexpensive to manufacture and use.

Figure 14:
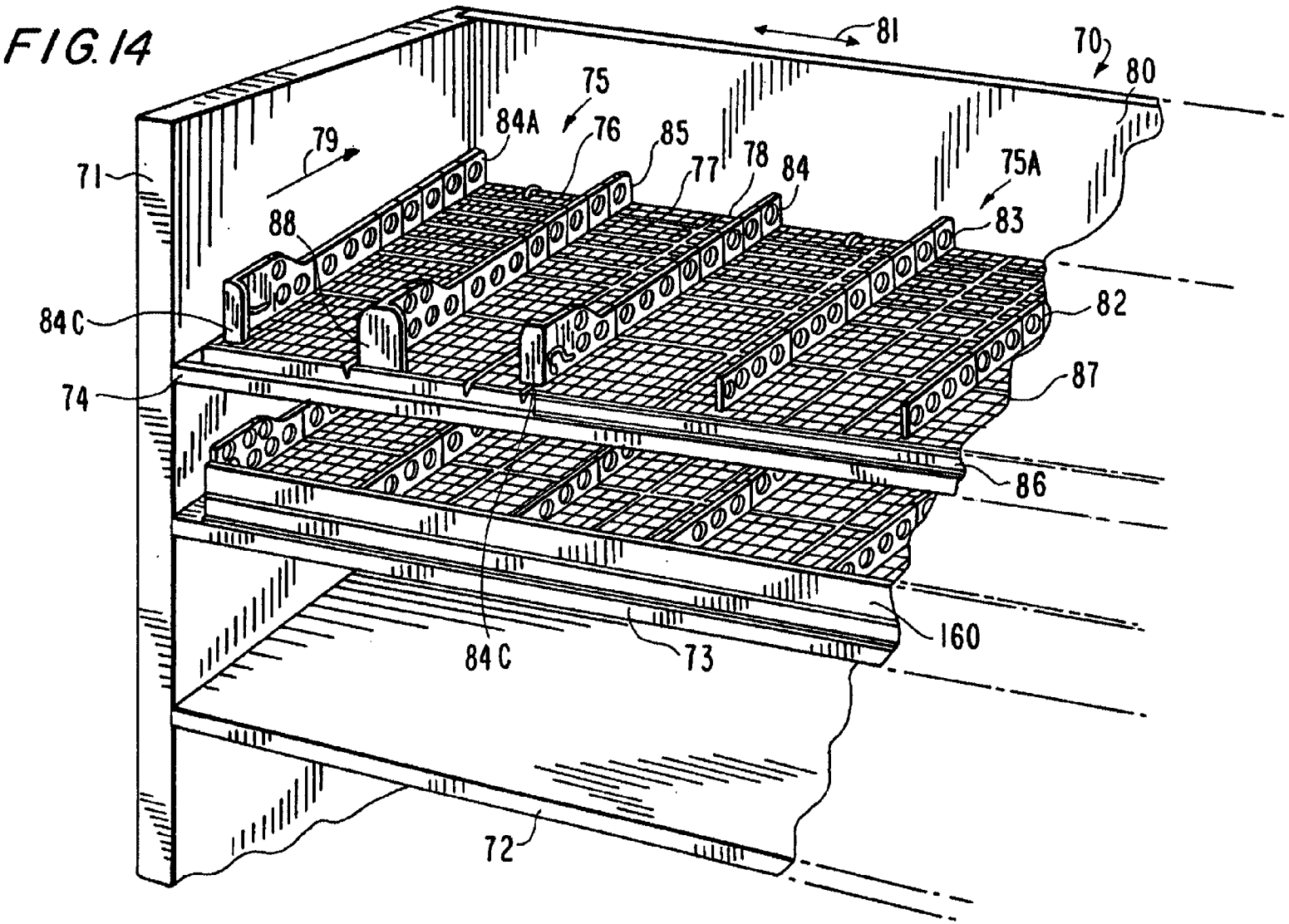
FIG. 14 is a fragmentary top, front perspective view of a display cabinet or gondola containing a plurality of the new display tracks of this invention.

Further embodiments of the present invention will now be described with reference to FIGS. 14–30. FIG. 14 shows a fragmentary front prospective view of a cabinet or gondola 70 as typically used in a retail sales display environment which has a right side wall 71, a left side wall not shown, and principal support shelves 72, 73 and 74 which are secured to the side walls. These shelves may be solid boards as shown or maybe wire racks 150 as seen in FIG. 27 and described later, or may have still other structure. Support shelves 72–74 are inclined slightly upward in the direction from the front to the rear to provide the gravity feed for products, boxes or other containers, which then tend to slide downward to the front of the display.

The embodiment of the new invention as seen in FIG. 14 comprises a display track 75 (also called display tray or floor) formed of display track units 76, 77 and 78 which extend rearward in the direction of arrow 79 toward the back wall 80 of the display box and extend transversely, left and right as indicated by arrow 81 between the side walls. Wide shelves can hold a plurality of side-by-side display tracks releasably coupled together, as indicated in FIGS. 6 and 14–16.

Each display track is adapted to receive one or more vertical partitions as indicated by reference numbers 82, 83, 84 and 85, which are removably insertable onto the top surface of the display track. These partitions may vary in height and shape and in the manner of coupling to a display track unit as described later herein.

Typical display tracks include a stop 86 which may be provided in the form of a short vertical wall at the front edge to restrain product boxes or other containers from sliding completely off the front of each display track. The basic stop member 86 is a strip having slight height, extending transversely and formed integrally with the base 87 of the track. Some other stops are taller and curved at the top, suggestive of a cathedral and called by that name and shown by reference 88.

As was discussed above, and as seen in FIGS. 6 and 14–16, each of these display tracks is extendable or shortenable in the front-to-rear direction and is extendable or shortenable in the transverse direction, in order to most efficiency use the space within the side walls of whatever display cabinet or gondola is being used.

Figure 15:
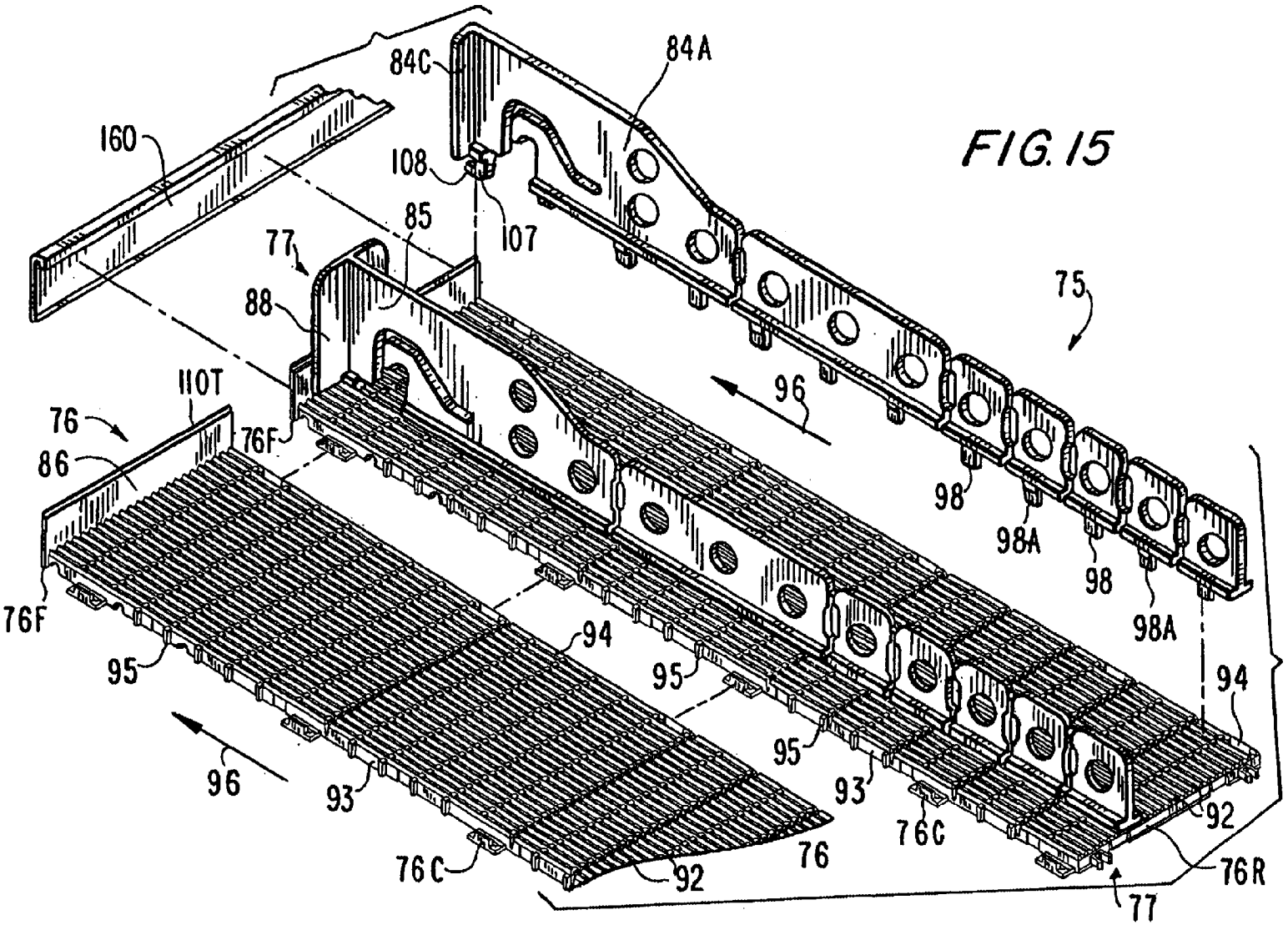
FIG. 15 is a fragmentary top, rear prospective exploded view of a display track including removable display track units and a front lip extender.

FIG. 15 shows a top rear prospective view of display track 75 comprising display track unit 76 which is attachable to an adjacent display track unit 77 by connections 76C, as described earlier.

Figure 15A:
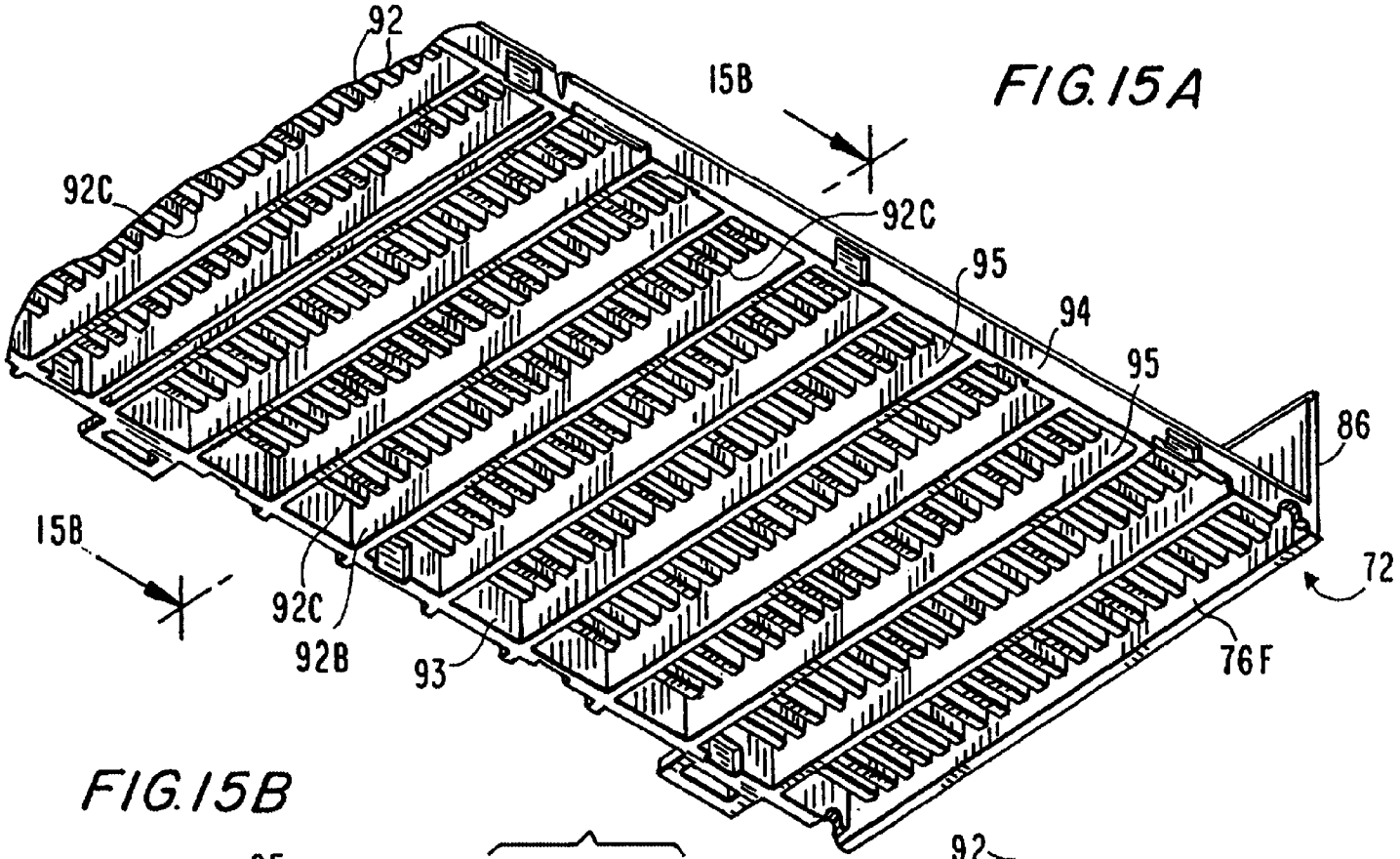
FIG. 15A is a fragmentary bottom, rear perspective view of a track unit of FIG. 15.

Each display track unit as seen in FIGS. 15 and 15A is formed by a plurality of longitudinally extending product support means or ribs 92 which are bounded on each marginal side by a longitudinally extending left side marginal support 93 and right side marginal support 94. There are a plurality of transversely extending beams 95 which extend between marginal side walls 93 and 94 and engage each of the longitudinally extending ribs 92. This entire display track is preferably formed by a single operation injection molding procedure. The aligned ribs 92 have top surfaces lying in a top plane at a first level defining a track or product support surface where products are situated and slide downward to the left in the direction of arrow 96, which is to the front of this product.

Since the side walls 93 and 94 extend downward below the bottom surface 92C of longitudinal ribs 92, as seen in FIGS. 15, 15A, 16–18, 22–24 and 26, there is established a basement 92B wherein said bottom surfaces of ribs 92C form the ceiling of the basement. This basement is a chamber bounded by said ceiling 92C, side walls 93, 94 and front and rear end walls 76F, 76R. As seen, these track units are essentially flat on top devoid of upstanding side walls, and define a basement chamber beneath the longitudinal ribs 92 that provides a space for secure but releasable coupling of the partitions 82–85 to the track units and for secure but releasable coupling one track unit to another. Since one objective is to maximally utilize the total vertical height in the cabinet, the basement allows an unobstructed top surface of each track unit and a space of shallow depth beneath each top surface for all the coupling requirements. As will be further described below, the transverse beams 95 being spaced apart in the front-to-rear direction, provide subchambers, to accommodate and support engagement of the coupling elements of the partitions and engagement of the further coupling elements for joining display track units as lateral extensions in the transverse direction, and/or as longitudinal extensions in the front-to-rear direction.

Figure 15B:
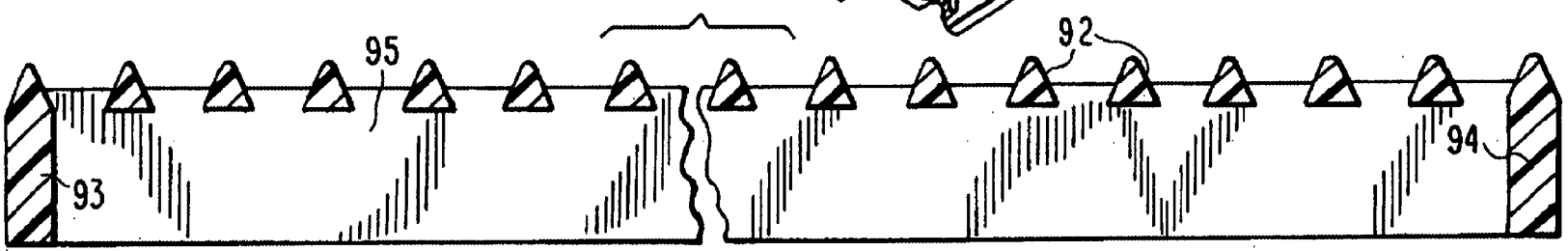
FIG. 15B is a fragmentary sectional view taken along line 15B—15B in FIG. 15A.
Figure 16:
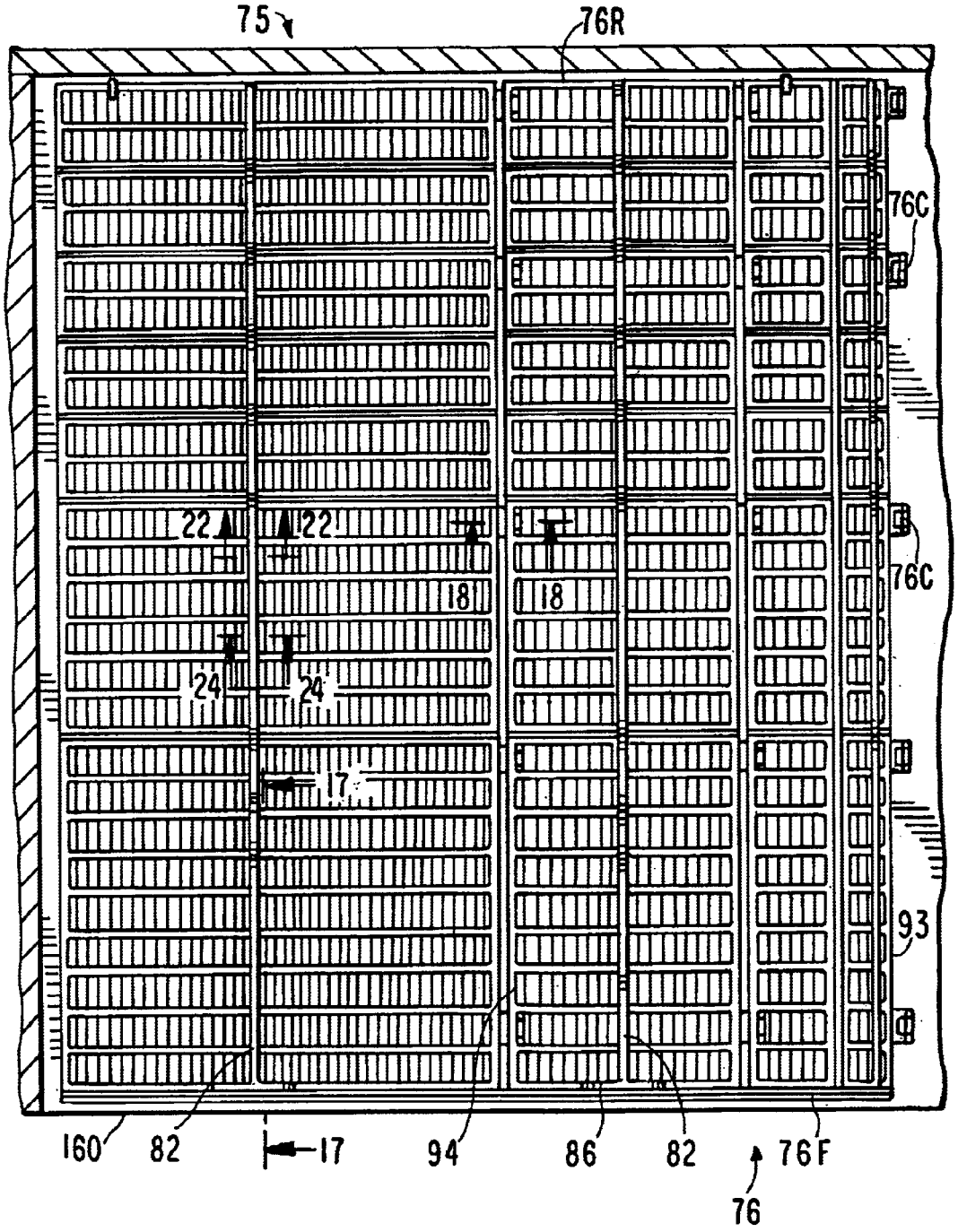
FIG. 16 is a top plan view of display track unit of FIG. 15.

FIGS. 15A and 15B, as presently amended, further illustrate (a) the top surfaces 92T of ribs 92 lie in a top plane T—T which defines the track on which products are slidably supported; (b) the bottom surfaces 92U of ribs 92 lying in a bottom plane U—U which define the ceiling of the basement; and (c) the top surfaces 95V of beams 95 lie in an intermediate plane V—V which is below top plane T—T. Sliding products can contact surface 92T and do not contact surfaces 95V.

The longitudinal ribs 92 are seen more clearly in FIGS. 22–27 where their cross-section is shown as a generally triangular shape with a slightly rounded top edge 97, the top edge being of relatively small area to minimize friction between it and the products which are supported and slide thereon. The triangular cross-section also provides adequate strength against bending of the beam, and the inclined sides provide a taper which enables removal of the product from the injection mold after injection is completed.

The partitions can be installed essentially anywhere in the transverse direction between any two adjacent longitudinal ribs of any track unit, and even between two adjacent marginal side walls of two adjacent but coupled-together track units. Two different embodiments of partitions are illustrated herein. Both have the same general shape and construction of the upstanding body part or blade part, but each has a different lower part that functions as the coupling element for engagement to a display track unit.

The upstanding partitions have various forms and combinations. FIG. 14 shows a set of partitions 84, 85 and 84A, where partitions 84 and 84A each have a short right angle wall 84C which serves as a stabilizer and/or stop for articles sliding downward against said stop. Between partition 84 and 84A is the intermediate partition 85 whose front end terminates in the cathedral stop 88 which cooperates with the adjacent right angle stops 84C.

To the right of partition 84 is the plain partition 83 which has no elevated body part like the one seen at the front of partition 85 and no front stop part, except for the standard stop 86 formed as a transverse lip. On the lower shelf 73 the partitions on the display tracks have the transverse lip 86 (not seen) plus a lip extender 160 to extend the height of lip 86, as seen more clearly in FIGS. 15 and 17 and further described below.

Figures 17, 18:
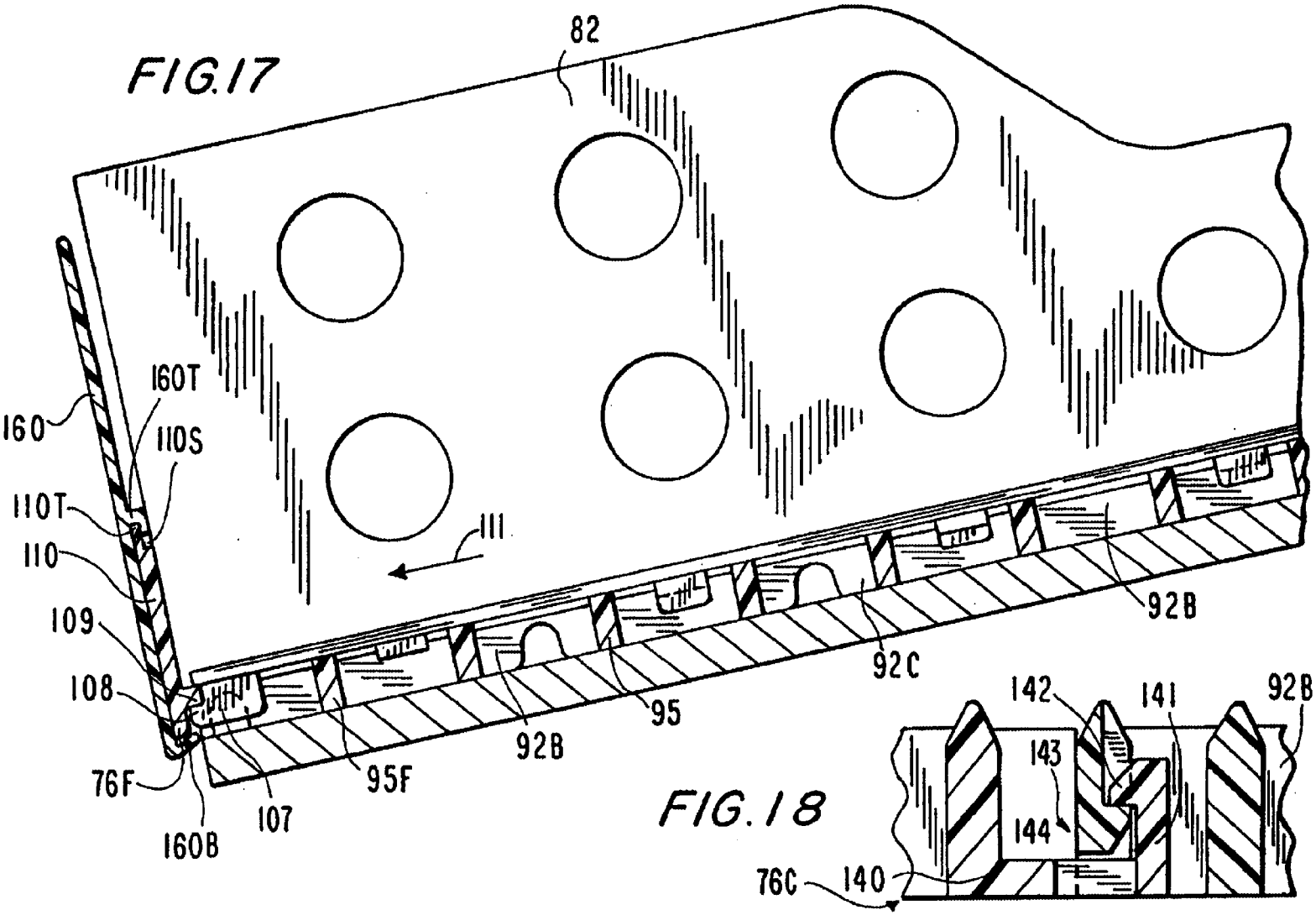
FIG. 17 is a fragmentary left side elevation view of the display track in section and of a partition and front lip extender assembled together, taken along line 17—17 in FIG. 16.
FIG. 18 is a fragmentary sectional view taken along line 18—18 in FIG. 16 showing the connection of two side-by-side segments of the display track.
Figures 22, 23, 24, 25:
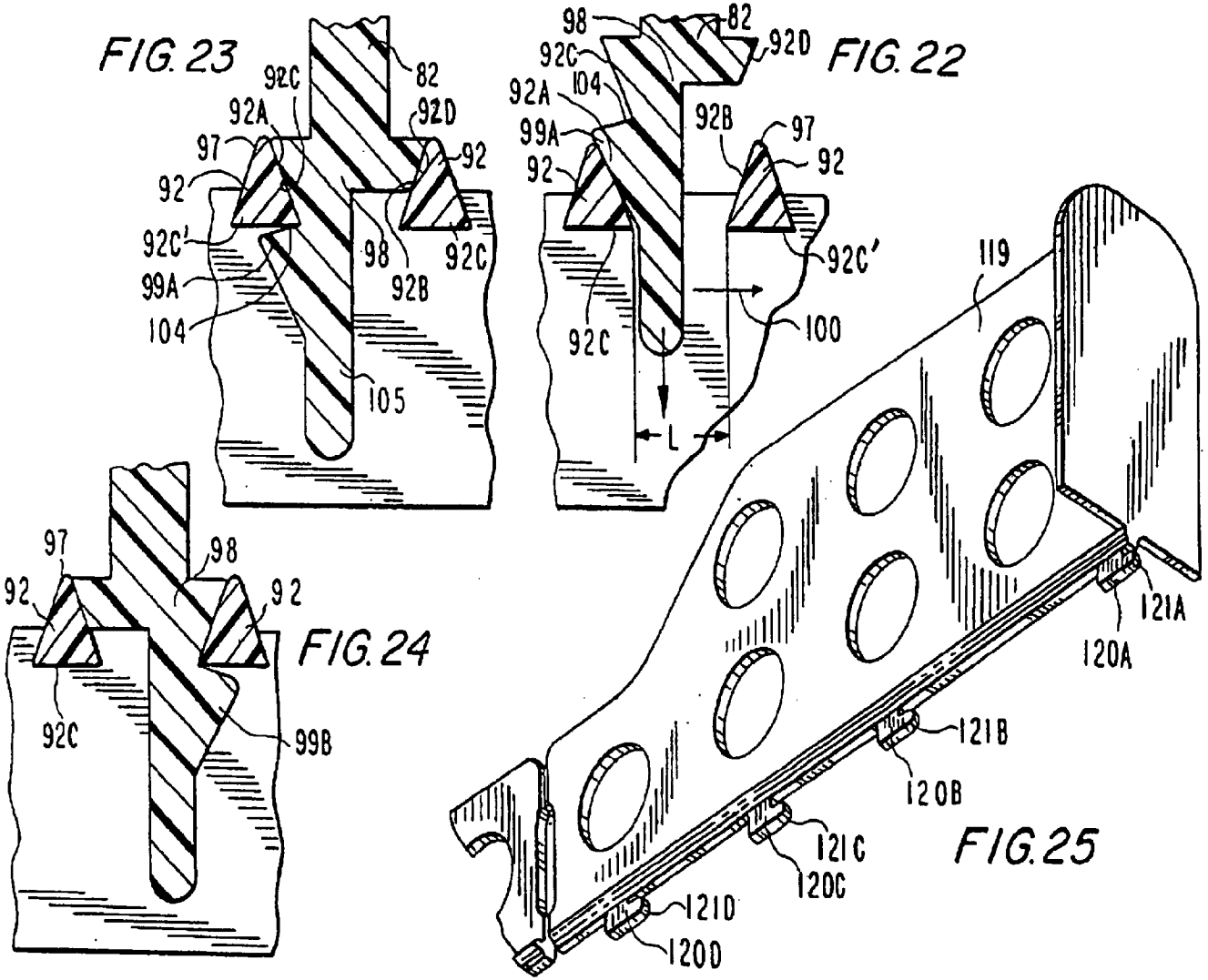
FIG. 22 is a fragmentary sectional view taken along line 22—22 in FIG. 16 showing the connector of a partition beginning engagement with a display track.
FIG. 23 similar to FIG. 22 showing the connector fully engaged.
FIG. 24 is a fragmentary sectional view taken along lines 24—24 in FIG. 16 showing the connection of the partition into the shelf at a location longitudinally displaced from the connection in FIG. 23.
FIG. 25 is a fragmentary front and bottom prospective view of a second embodiment of a partition.
Figure 26:
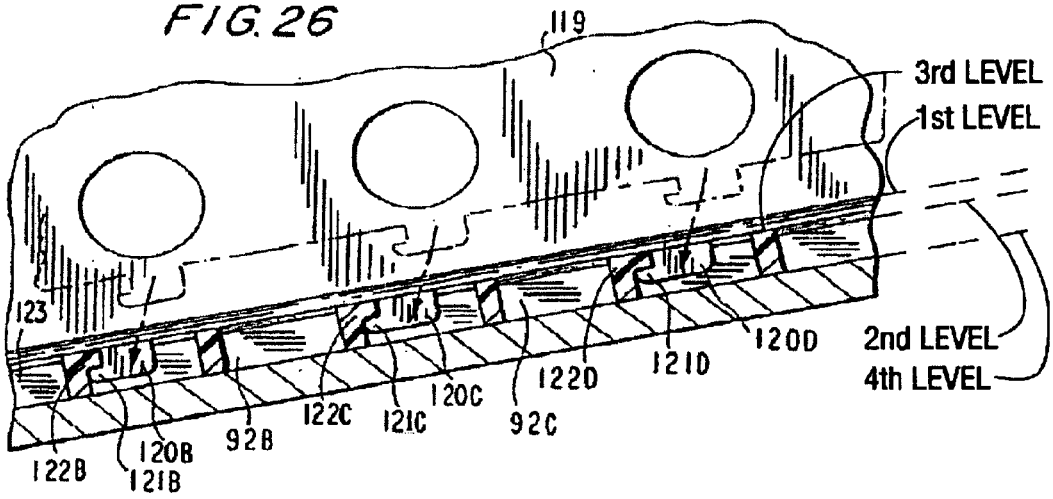
FIG. 26 is a fragmentary side elevation view partially in section showing the partition of FIG. 25 assembled with the shelf of FIG. 14.
Figure 27:
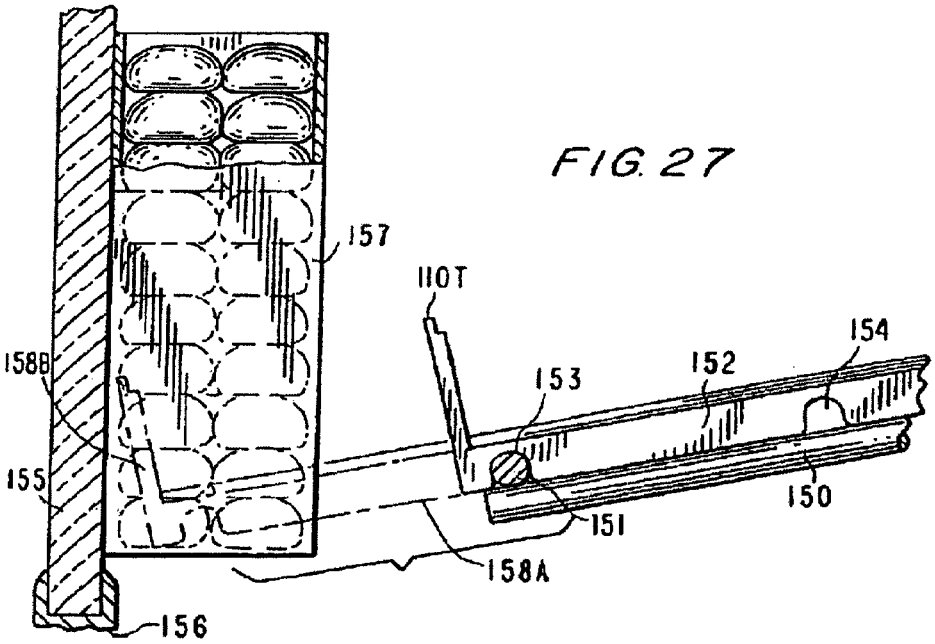
FIG. 27 is a fragmentary left side elevation view of a display track in a cabinet.

A first embodiment of the partitions is illustrated by FIGS. 15, 19 and 22–24; a second embodiment is illustrated in FIGS. 17, 25 and 26. As seen in FIG. 15, partition 84A has coupling element 98 extending downward from its bottom edge. When this partition is installed on a display track unit, as seen in FIGS. 22–24, the partition is positioned to be aligned with a pair of adjacent spaced apart longitudinally ribs 92 and to have its coupling elements 98, seen in FIGS. 15, 19 and 22–24, positioned between a pair of adjacent ribs 92. The partition is forced downward causing each element to be inserted between ribs which causes one or more ribs to deflect and/or causes the coupling element to deflect, such that the element descends until its releasable locking tooth 99 descends to a position below the bottom edge 92C of longitudinally extending rib 92, where it locks thereunder. This tooth remains locked until the partition is forcibly pulled upward.

As further illustrated in FIGS. 22–24, inclined surface 104 of the tooth 99A allows the lower portion 105 of this coupling element to cam outward and flex as the partition is pulled upward and the element is released from said locked position between two longitudinal ribs. The space L between longitudinal beams 92 is defined by a pair of tapered walls 92A and 92B which together form a triangular shape tapering from a wider opening at the top to a smaller opening at the bottom. Surfaces 92A, 92B are dimensioned to receive and hold surfaces 92C, 92D respectfully of the lower portion or coupling element 98 of the partition 82.

In FIG. 22 locking tooth 99A of the coupling element 98 initially rides against surface 92A, then is deflected inward as indicated by arrow 100, until tooth 99A descends and locks just below rib 92 as seen in FIG. 23.

Figures 19, 20, 21:
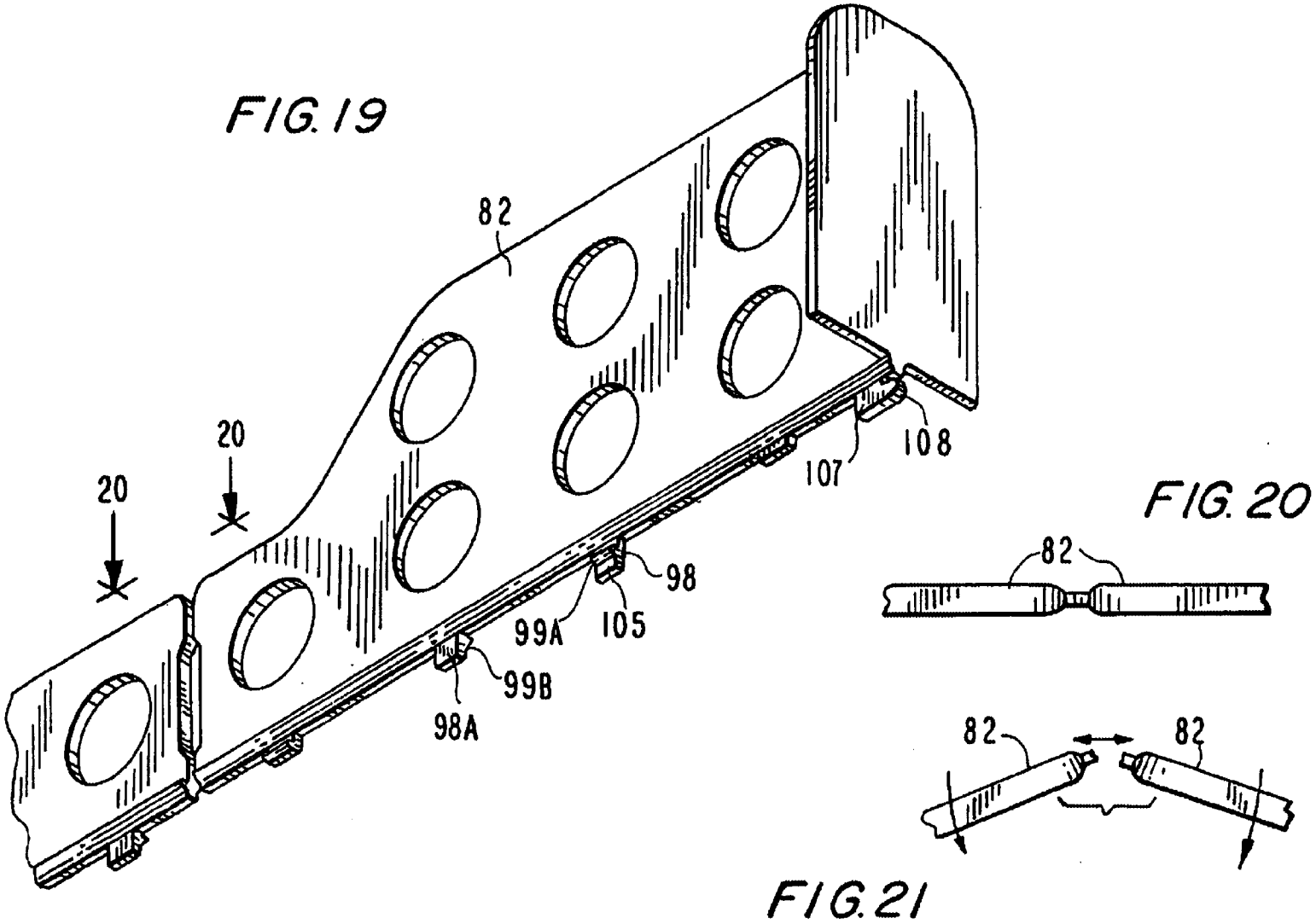
FIG. 19 is a bottom front perspective view of a partition.
FIG. 20 is a fragmentary top plan view of a portion of the partition of FIG. 6 taken along line 20—20 in FIG. 19.
FIG. 21 is a fragmentary top plan view similar to FIG. 20 of the partition, now broken apart.

As further seen in FIG. 23 surfaces 92C, 92D of the downward coupling element 98 of the partition lie against and are snugly supported by surfaces 92A, 92B of opposite faces of ribs 92A and 92B. FIG. 24 shows a coupling connection the same as that of FIG. 23, but longitudinally displaced therefrom as seen in FIGS. 15 and 19. Thus, teeth 99A, 99B on elements 98, 98A are alternately directed left and right along the length of the partition. This helps to stabilize the partition in both transverse directions, and also facilitates insertion of the partition by a downward force and removal by an upward force with slight tilting or rocking to cause dislodgement of the locking teeth 99A, 99B.

Each of these first embodiment partitions has additional means to insure that after it is inserted, it does not easily dislodge due to movement of product or due to touching by users or retail customers. As seen in FIG. 19 the partition has a tab 107 which has a forward extending finger part 108. The partition is installed downward and then slid forward, and the finger 108 moves under a rearward extending bar 109, as seen in FIG. 17, extending rearward from the front wall 110 of the display track unit. Finger 108 becomes releasably locked under bar 109.

The second embodiment 119 of the partition as seen in FIGS. 25 and 26 utilizes releasable locking tabs 120A–120D with forward directed fingers 121A–121D respectively. Tab 120A and its finger 121A are similar to tab 107 and finger 108 in FIGS. 17 and 18; however, this partition 119 has no transversely directed locking finger 99 seen in FIGS. 22–24. As seen in FIG. 26, partition 119 has a plurality of longitudinally spaced, forwardly directed fingers 121A–121D which, acting together, restrain the partition from being dislodged or lifted at any point along its length, until it is specifically pushed rearwardly to disengage all the fingers 121A–121D from beneath the respective transverse bars 122A–122D of display track unit 123. FIG. 26 does not show the forwardmost finger 121A and bar 121D which corresponds in shape and function to those seen in FIG. 17. In one variation of this embodiment there would be only two forwardly directed fingers, namely one at the front end of the partition and a second situated either at the rear of the partition or at the rear of the primary segment of the partition before the first break-away area. Accordingly, no matter how many segments were broken away, at least the always-remaining primary and forwardmost segment would be downwardly restrained unless and until it were slid rearward.

Figure 26A:
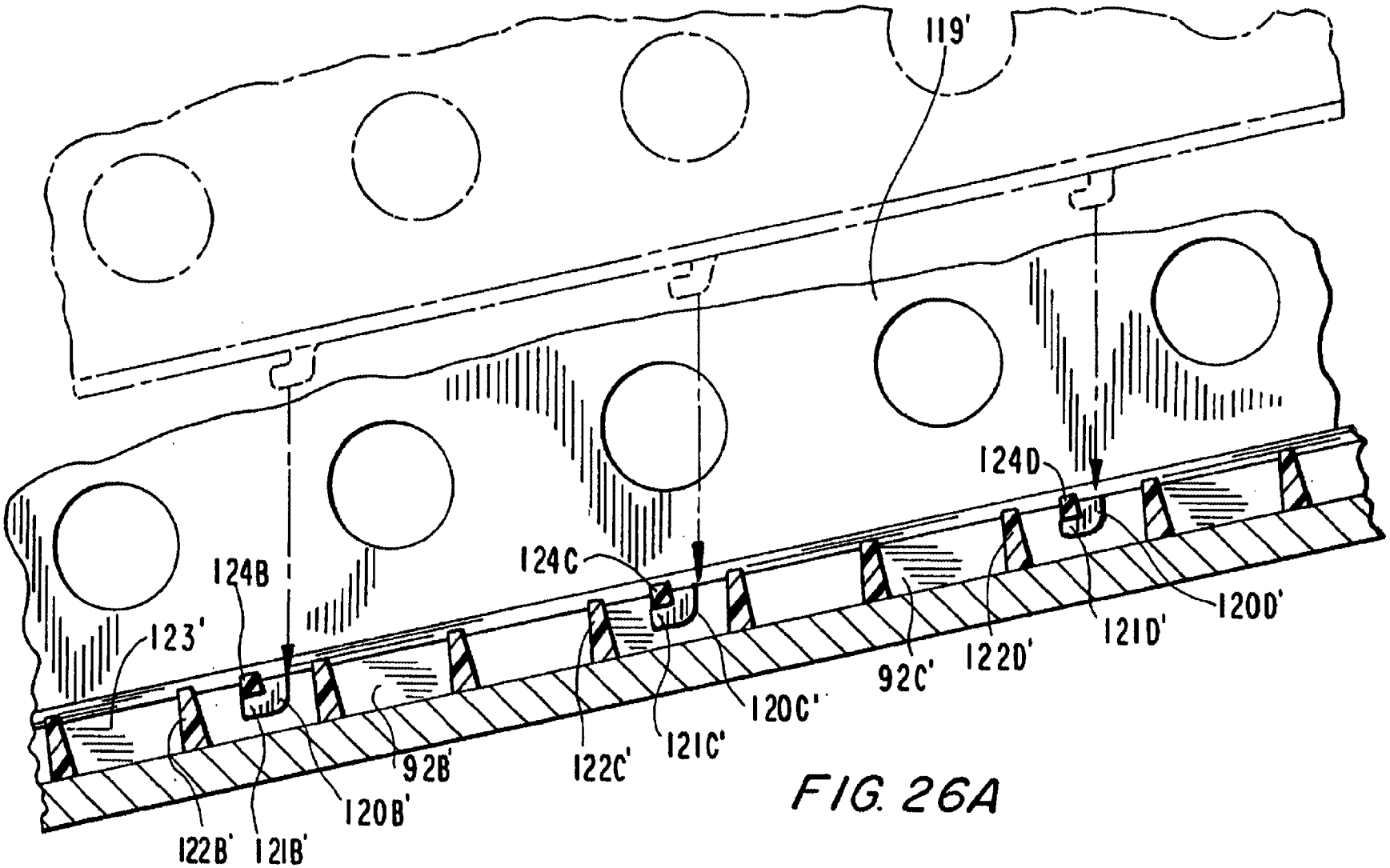
FIG. 26A is similar to FIG. 26, but show a further embodiment of the partition and display track.

FIG. 26A illustrates a variation of the partition and display track connection. In FIG. 26A partition 119' has downwardly directed fingers 120B'–120D', each having a forwardly directed finger 121B'–121D' which engage respectively transverse beams 124B–124D which extend across the display track between the outer side walls and beneath the longitudinal ribs. Each of beams 124B–124D is situated between two adjacent principal transverse beams, such as those marked 122B'–122D'. A typical finger 121C' engages under a beam 124C when the partition 119' is slid forwardly, and this coupling releasably secures the partition to the display track.

Figure 28:
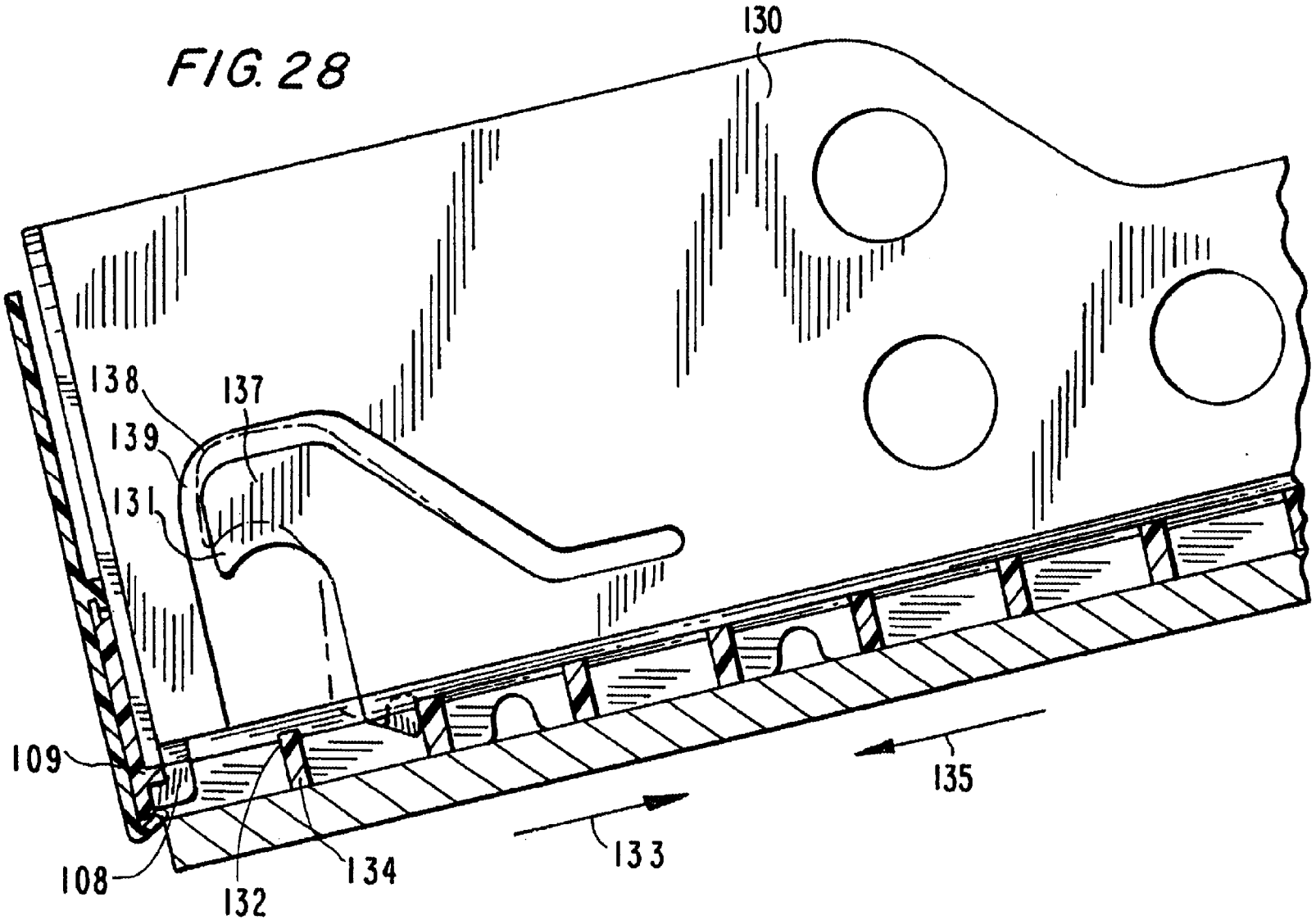
FIG. 28 is a fragmentary side elevation view similar to FIG. 17 showing a further embodiment of the new partition.

Since there is the possibility of the partition being accidentally pushed rearward by a store operator or by a customer, a third embodiment 130 of the partition as seen in FIG. 28. This partition has a spring element 131 whose finger 132 resiliently pushes in a rearward direction of arrow 133 against transverse bar 134 of the display track unit. This resiliently urges the partition 130 in the forward direction of arrow 135 and thus urges locking finger 108 to remain beneath transverse bar 109. This prevents any accidental rearward movement of the partition and accordingly prevents accidental or unintentional upward movement of the partition out of its proper position and alignment.

In this embodiment spring element 131 is formed as a trigger 137 having a relaxed state as shown, and which is movable upward to the position indicated by dotted line 138 so that finger 132 clears transverse beam 134, and the partition can be slid rearward. This trigger is formed by cut-out portions 139, leaving finger hole 137A for easy engagement by the user.

Figure 29:
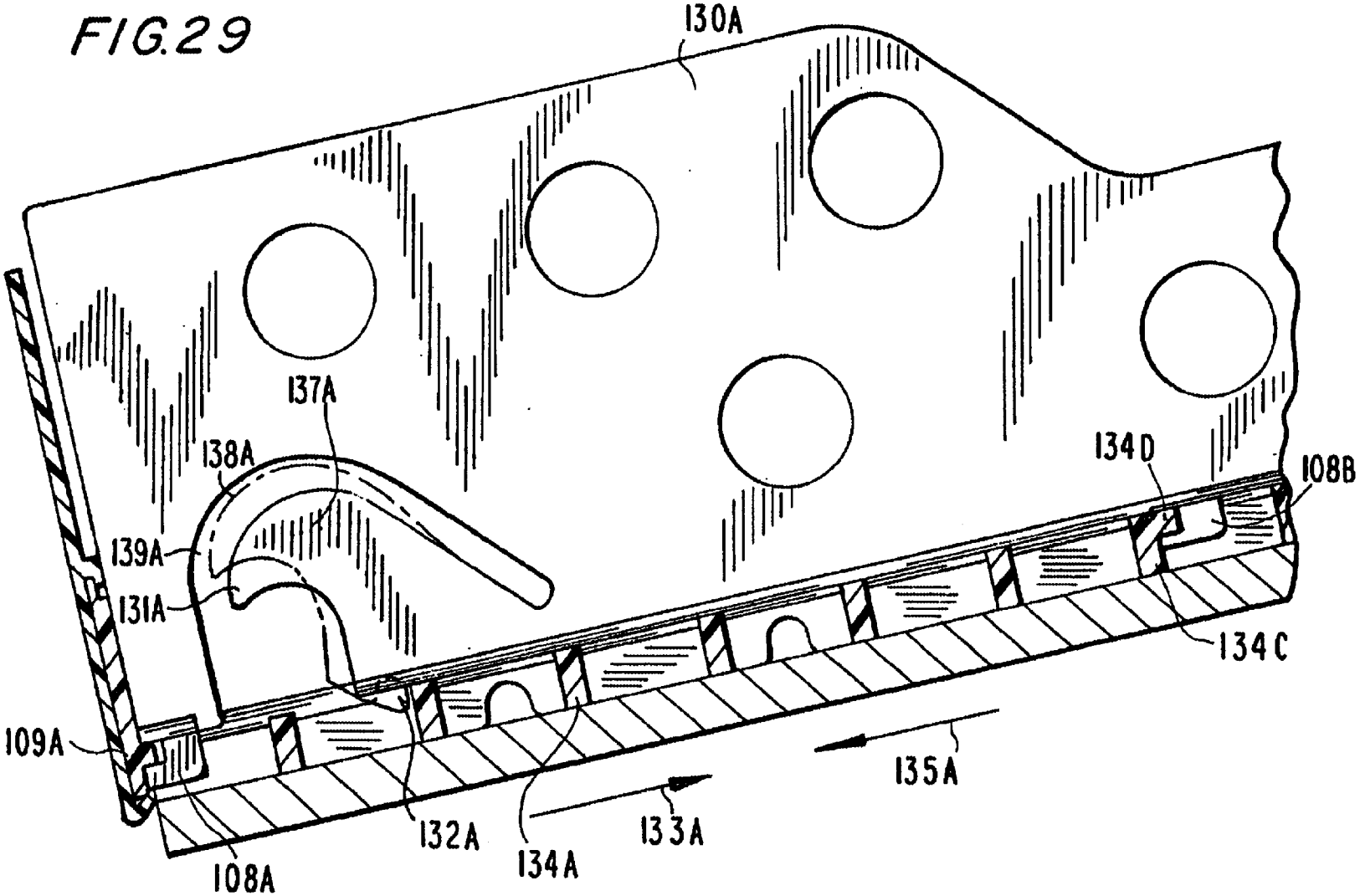
FIG. 29 is a fragmentary side view similar to FIG. 28, showing a further embodiment of a partition with a trigger release element.

A further embodiment of a partition with a trigger release is illustrated in FIG. 29 where for convenience elements corresponding to those in FIG. 28 are given the same reference number followed by an "A". Accordingly, in FIG. 29 of the partition 130A has a finger 132A extending from a resilient trigger element 137A, the latter be defined by cutout area 139A. This partition has a front locking finger 135A that functions is finger 135 in FIG. 28.

In FIG. 29 partition 130A has, in addition to forward finger 108A, a rear finger 108B which extends forwardly beneath transverse rib 134D on transverse beam 134C. FIG. 15 illustrates the separable segments of partition 84A to reduce its length as desired, and it is useful to have a separate finger 108B of FIG. 29 extending from the bottom of each of said separable segments so that all remaining segments after severing will have floor-engaging means. This will assure restraint from lifting either end of the partition unless and until it is slid rearwardly to first disengage its floor-engaging means.

As discussed above, each display track unit has break-away areas so that longitudinally extending segments of track can be removed. Also, as discussed, such longitudinally extending segments can be added by using the transverse releasable connectors marked 76C in FIGS. 15–18. A typical connector as seen in FIG. 18, has a transverse base 140, an upward stem 141 and a transverse locking finger 142. At a corresponding longitudinal location the adjacent display track segment to be attached has a window 143 and a latching lip 144. The engagement of locking finger 142 and latching lip 144 occurs in the basement portion 92B of the track unit as seen in FIGS. 17 and 18. This basement structure described above provides rapid, easy and secure releasable coupling while utilizing the height aspect of the space efficiently.

The coupling elements for longitudinal extension of track as described above also utilize this basement structure to create and interlock both the male and female components thereof.

A still further feature is a front lip extender 160 illustrated in FIGS. 15, 16, 17 and 28. As seen in FIG. 15 a display track unit 77 maybe extended transversely by the coupling thereto of adjacent display track unit 76. For this connection coupling members 76C of track unit 77 engage in mating coupling elements formed in the basement structure of display track unit 76, the detail of which is seen in FIG. 18. Because this coupling is designed to be easily engageable and disengagable, it is less rigid than an integral construction against downward bending of one display track with respect to the other. Normally bending is not a problem since these display track units are supported on a horizontal shelf; however, to enhance the strength of this assembly against bending there is provided the front lip extender 160 which releasably attaches to the front lip portions of coupled display track units. FIG. 15 shows the display track units to have a front stop wall or lip 86, and lip extender 160 is applied to these lips. FIG. 17 shows the front stop wall designated 110 with a top lip 110T displaced slightly outward leaving a small slot 110S behind lip 110T.

The lip extender 160 is a strip having a bottom lip 160B which engages under bottom edge 76F of the display track front wall, and has top flange 160T which locks over and behind lip 110T and into slot 110S. Lip 110T is also seen in FIGS. 15 and 27. When lip extender 160 is engaged to two or more aligned and coupled display track units, the strength of the assembly against bending is greatly enhanced, particularly because the lip extender has a high height to thickness ratio and thus is subject to shear forces rather than bending. This lip extender is quickly and easily attachable and removable, and serves the added function of heightening the stop wall to prevent products from falling forward.

FIG. 27 discloses a further structural feature which may be used as a "candy blocker" with any of the display tracks and partitions described above. This structure is particularly useful with gondolas where the shelf is formed as a wire rack or substrate 150 having an upward projecting element in the form of a transverse front wire 151. The display track unit 152 has upward extending recesses or notches 153 and 154. The new display track is positioned downward until its recess 153 overlies a transverse wire 151 of the rack. This engagement positions the display track properly and prevents it from moving forward or rearward. The plurality of notches 153, 154 allows the display track to be moved as far forward as possible toward the front door 155 of the cabinet 156 to the position shown by dotted lines 158A, 158B. In this forward position the display track is sufficiently close to door 155, that a store operator is prevented from installing on the inside of door 155 a container 157 for candy bars or the like. Such a container, if it were installed, would extend rearward from the front door, and would block the retail customers' view of what products were on the display track. Obviously, it is in the interest of those selling products in the display tracks, that such products be seen without obstruction or distraction.

Figure 30:
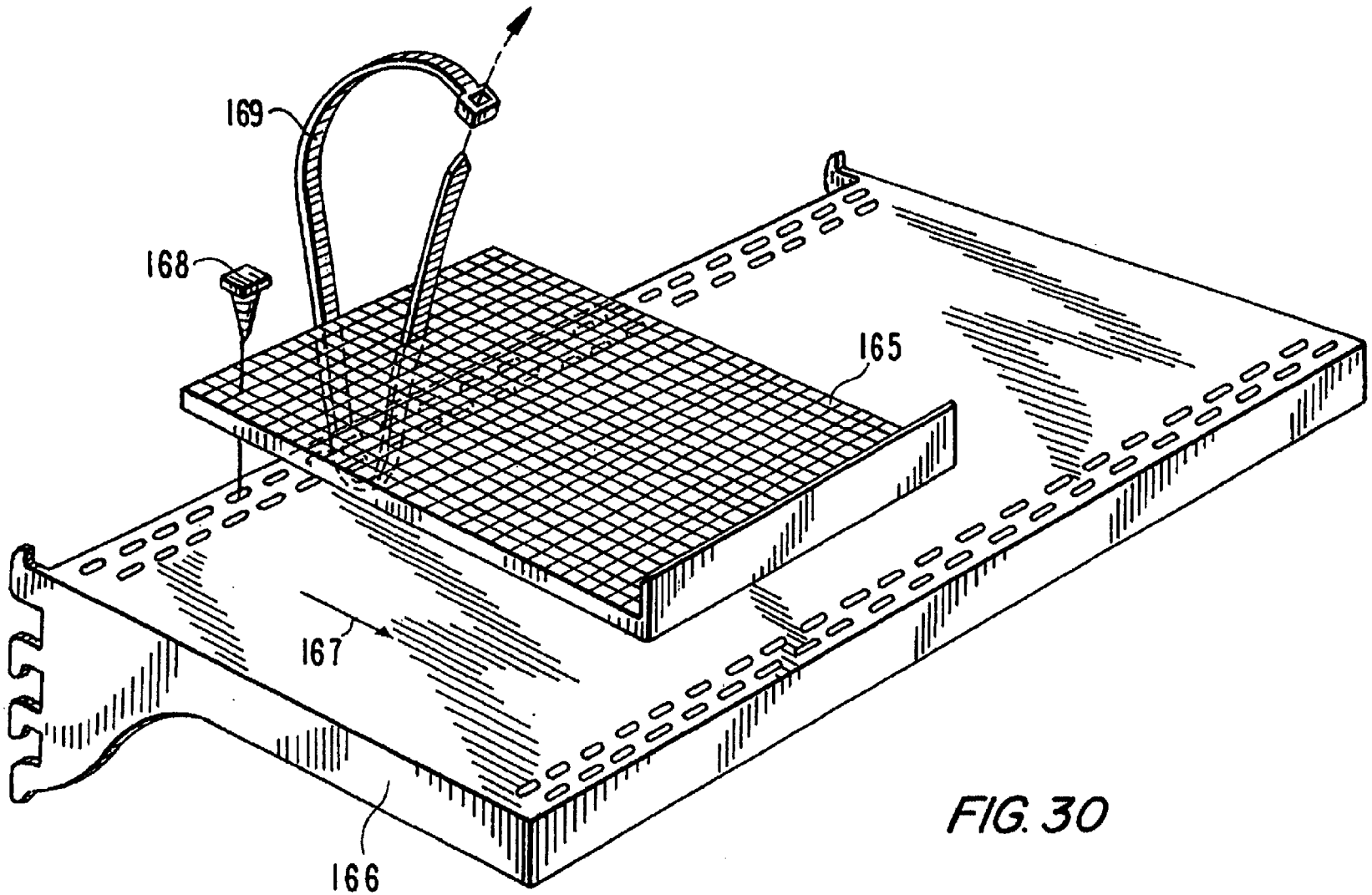
FIG. 30 is a top, front perspective view of a gondola shelf of FIG. 14 with a display track.

FIG. 30 illustrates the concept that a display track 165 on the downward inclined gondola shelf 166 can be restrained from sliding forward in the direction of arrow 165 by restraining means which may take the form of pins 168 as shown, or tie wires 169 coupling the display rack to the rear of the shelf, or by other well known means.

Figures 31, 32:
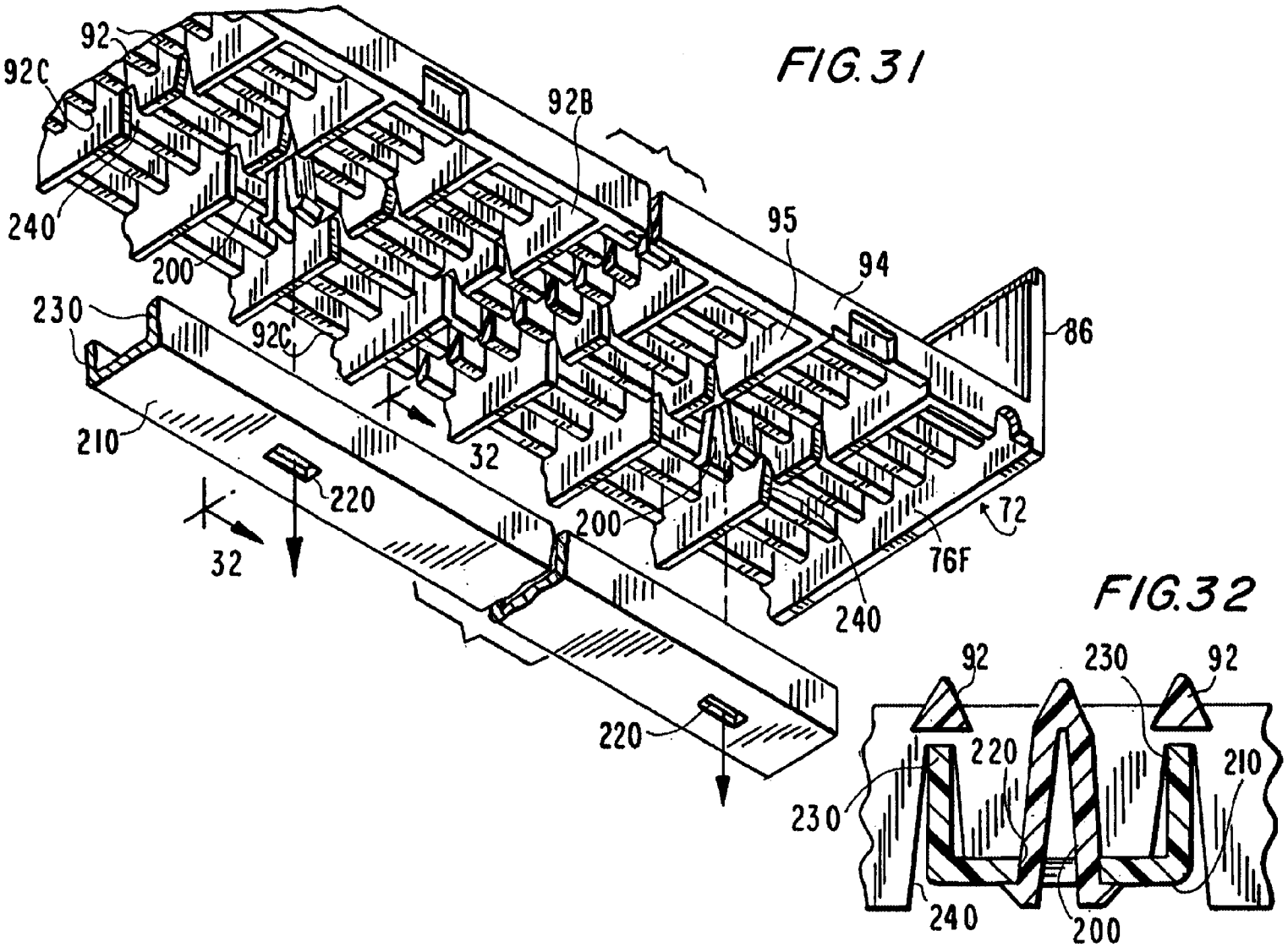
FIG. 31 is an exploded bottom perspective view of the track and support channel.
FIG. 32 is a cross-sectional view of the assembled track and support channel taken along line 32—32 of FIG. 31.

FIGS. 31 and 32 illustrate one final embodiment where a channel 210 with upstanding flanges 230 is secured below display track 72. The channel is strong metal such a steel or aluminum and extends longitudinally. Releasable coupling is achieved by spring fingers 200 which extend from the display track downwardly into slots 220 of the channel. The track 72 includes grooves 240 th receive the flanges 230. The channels reside within the display track basement and provide substantial added strength and stability against bending and/or twisting of the display track when loaded.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the forgoing specification.

What is claimed is:

1. An integrally molded display floor devoid of integrally molded side walls upstanding therefrom, comprising:

(a) opposite front and rear ends, (b) a plurality of laterally spaced apart longitudinally extending ribs connected to said front and rear ends with a longitudinal slot defined between each two adjacent ribs, said ribs having top surfaces which define a top plane of said floor at a first level for supporting products to slide thereon and bottom surfaces which define a second level below said first level, (c) a pair of opposite side walls connected to said front and rear ends, said side walls having bottom surfaces at a third level below said second level, and (d) a plurality of longitudinally spaced beams extending transversely between said side walls and intersecting and joining said ribs, said beams having top surfaces at a fourth level below said first level and having bottom surfaces, said side walls, front and rear walls and bottom surfaces of said ribs defining a basement where said bottom surfaces of said ribs and bottom surfaces of said beams define a discontinuous ceiling of said basement.

2. The floor of claim 1 including at said front end thereof a front lip extending above said top plane to block forward movement of products from said floor.

3. The floor of claim 2, further comprising a pair of display floors releasably coupled to each other in side-by-side relationship, further comprising a lip extender formed as a transverse strip having length essentially the same as the combined transverse widths of said coupled display floors and height greater than that of said front lip, said lip extender situated to overlie and be releasably coupled to said lips of said coupled floors to thereby stiffen the junction therebetween.

4. The floor of claim 3 wherein each of said lips includes an upper edge and a lower edge, and said lip extender has on its rear side a pair of transversely extending and vertically spaced flanges which engage said upper and lower edges respectively.

5. The floor of claim 2 wherein said front lip extends upwardly from the bottom of said ribs.

6. The floor of claim 1 further comprising both length extension means and width extension means at the rear end and at at least one of said side walls respectively for extending the length and width of said floor.

7. A floor according to claim 6 releasably coupled to a second display floor, in side-by-side relationship by said width-extension means, wherein each of said width-extension means comprises a male element extending transversely from a sidewall of one of said floors and a female receptacle formed as part of said basement of the other of said floors.

8. The floor of claim 1 comprising a display tray having at least one laterally spaced pair of integrally molded, relocatable, longitudinally-extending partitions upstanding from said top plane, said adjacent pair of said partitions and a portion of said track therebetween defining a travel path for products.

9. The floor of claim 8 wherein each said partition defines below a bottom edge thereof a plurality of downwardly-extending half-arrowheads disposed below said top plane and in said basement, for temporary lateral displacement of and downward insertion past segments of an adjacent pair of said ribs for releasably receiving said partition to said display floor.

10. The floor of claim 9 said half-arrowheads are spaced below said bottom edge by the height of said ribs.

11. The floor of claim 10 wherein alternating ones of said half-arrowheads are laterally oriented in opposite directions, and said bottom edge defines a plurality of upwardly-extending slits enabling generally independent lateral movement of said alternating half-arrowheads.

12. The floor of claim 9 wherein each said half-arrowhead has a top surface defining a bevel to facilitate upward removal of said partition from said floor.

13. The floor of claim 8 wherein a bottom edge of said partition additionally includes at the front thereof, first floor-engaging means for engaging said floor to block lifting of said partition from said floor at the front thereof.

14. The floor of claim 13 wherein said floor-engaging means comprises an element extending beneath a front portion of said floor.

15. The floor of claim 13 wherein said first floor-engaging means comprises a finger extending forwardly in the direction of said front end of said floor.

16. The floor of claim 15 wherein said partition additionally includes second floor engaging means similar to and longitudinally spaced rearwardly from said first floor engaging means.

17. The floor of claim 13 wherein each of said partitions further comprises a biasing element engaging said floor and urging said partition forward, thus urging said first floor-engaging means to remain in engagement with said floor and thereby to block lifting of said partition.

18. The floor of claim 8 wherein said basement defines a chamber where said floor forms the ceiling of said basement, and said transversely extending beams define between them sub-chambers of said basement.

19. The floor of claim 8 wherein each of said partitions further comprises at least one downward extending floor-engaging means which is extendable downward between two adjacent ribs for releasable engagement to said floor.

20. A floor of claim 1 wherein said ribs have a generally triangular cross-section with the apex of each triangle pointed upward and the base of the triangle forming part of said basement ceiling.

21. A floor of claim 20 wherein each of said ribs intersects and joins said transversely extending beams such that a portion of said triangle extends above the top of each of said transversely extending beams.

22. A floor of claim 21 wherein each of said triangles extends above said transversely extending beams by approximately one half of the triangle's height.

23. A floor of claim 1 positionable on an inclined gondola shelf, said display floor further comprising at its rear end rear attachment means for releasably coupling said display floor to said gondola shelf.

24. A floor according to claim 23 wherein said rear attachment means comprises a pin coupled to said floor and to said gondola shelf.

25. A display floor according to claim 1 wherein said beams have bottom surfaces at a fifth level below said second level and above said third level.

26. A display floor according to claim 1 wherein each of said basement chambers extends transversely substantially the full width said floor.

27. A display floor according to claim 1 wherein said bottom surfaces of said beams lie at said third level.

28. A display floor according to claim 1 wherein for each of said ribs said top surface has area less than the area of said bottom surface.

29. A display floor according to claim 28 wherein said ribs are generally triangular in cross section and oriented with one corner of the triangle at the top.

30. A display floor according to claim 1 having at least two longitudinally extending partitions, each partition comprising a panel with a lower edge, said partitions being attachable in upstanding orientation to said display floor and removable therefrom, said partitions when attached to said display floor being transversely separated from each other and defining between them a travel path for said products on said top surfaces along said floor, each of said partitions further comprising first coupling means at the lower edge of said panel, said display floor further comprising a plurality of second coupling means, each adapted to receive one of said first coupling means to engage and releasably restrain a partition from disengagement from said display floor.

31. The floor according to claim 30 wherein said ribs are parallel to each other, said lower edge of each of said partitions has a predetermined generally uniform thickness, and wherein the transverse distance between each two adjacent ribs is substantially the same and is slightly greater than said predetermined thickness of said lower edges of said partitions to allow easy insertion of said lower edges of said partitions in between said adjacent ribs for engagement of said partitions of said floor.

32. The floor according to claim 30 wherein said first and second coupling means, when engaged, bar said partition from moving longitudinally toward the front or the rear of said display floor.

33. The floor according to claim 30 wherein said second coupling means comprises a transversely extending beam and said first coupling means comprises a toe part that is slidable under said transversely extending beam of said second coupling means, said partition being barred from upward movement from said display floor while said toe part is beneath said transversely extending beam of said second coupling means.

34. The floor according to claim 33 wherein said partition further comprises a spring finger having a first, relaxed position where it engages said display floor and bars said partition from moving longitudinally and thus bars said first and second couplings from becoming disengaged, and a second, flexed position where it is disengaged from said display floor and allows said partition to move longitudinally and allows said first and second coupling means to become disengaged.

35. A floor according to claim 34 wherein said spring finger is an integrally molded part of said partition and includes a trigger part pullable by a user to move said finger from said relaxed to said flexed position.

36. A floor according to claim 35 wherein said finger in its relaxed state engages said floor and resiliently urges said partition in said forward direction.

37. A display floor according to claim 1 wherein said ribs are situated parallel to each other and extend substantially the entire width of said display floor.

38. A display floor according to claim 37 wherein the outermost ribs on each side of said display floor comprise the top portions of opposite side walls.

39. A display floor according to claim 37 wherein the transverse distance between each two adjacent ribs is substantially the same.

40. The floor of claim 1 further comprising male and female width extension means on said opposite side walls respectively whereby said floor can be removably attached to a similar floor in side-by-side relationship by coupling of said male width extension means on one floor to said female width extension means on said similar floor.

41. A floor according to claim 40 wherein each of said female width extension means comprises walls defining space within said basement.

42. The floor of claim 1 including marginal longitudinal supports defining adjacent the front thereof a downwardly-opening recess adapted to receive an upstanding front edge of a substrate, whereby said floor can extend forwardly beyond said upstanding front edge of said substrate and serve as a candy blocker.

43. A partition removably attachable to a display floor, which display floor includes a frame formed of a plurality of laterally spaced apart longitudinally extending ribs with a longitudinal slot defined between each two adjacent ribs, and a plurality of transverse beams intersecting and joining said ribs, said partition comprising:

a generally flat panel with a bottom edge and a first coupling means on said bottom edge, said partition having a first position where it is oriented vertically with its bottom edge removably situated in one of said slots and said panel extends upwardly from said floor, and a second position where said panel is displaced longitudinally from said first position and where said first coupling means becomes releasably coupled to one of said transverse beams of said display floor, which coupling bars removal of said partition from said floor until said partition is moved back to said first position.

44. A partition according to claim 43 further comprising latch means extending from said bottom edge of said panel, said latch means having a first state where it engages said floor and bars said panel from moving out of its second position, and a second state where said latch means no longer bars said movement of said partition out of its second position.

45. A partition according to claim 44 wherein said latch is a spring element, and said first and second states comprise relaxed and flexed states respectively of said spring element.

46. A partition according to claim 45 wherein said latch is an integrally molded part of said panel and further comprises a trigger part which when pulled, moves said latch from said relaxed to said flexed state.

47. A partition according to claim 46 wherein said trigger is movable in a generally upward direction from said relaxed to said flexed state.

48. A partition according to claim 45 wherein relaxed state engages said floor and urges said panel in a forward direction.

49. In combination, an integrally molded display floor devoid of integrally molded side walls upstanding therefrom, comprising:

(a) opposite front and rear ends, (b) a plurality of laterally spaced apart longitudinally extending ribs connected to said front and rear ends with a longitudinal slot defined between each two adjacent ribs, said ribs having top surfaces which define a top plane of said floor at a first level for supporting products to slide thereon and bottom surfaces which define a second level below said first level, (c) a pair of opposite side walls connected to said front and rear ends, said side walls having bottom surfaces at a third level below said second level, and (d) a plurality of longitudinally spaced beams extending transversely between said side walls and intersecting and joining said ribs, said beams having top surfaces at a fourth level below said first level and having bottom surfaces, said side walls, front and rear walls and bottom surfaces of said ribs defining a basement where said bottom surfaces of said ribs and bottom surfaces of said beams define a discontinuous ceiling of said basement, at least two longitudinally extending partitions, each partition comprising a panel with a lower edge, said partitions being attachable in upstanding orientation to said display floor and removable therefrom, said partitions when attached to said display floor being transversely separated from each other and defining between them a travel path for said products on said top surfaces along said floor, each of said partitions further comprising first coupling means at the lower edge of said panel, said display floor further comprising a plurality of second coupling means, each adapted to receive one of said first coupling means to engage and releasably restrain a partition from disengagement from said display floor, said partition further comprises a spring finger having a first, relaxed position where it engages said display floor and bars said partition from moving in at least one longitudinal direction, and thus bars said first and second couplings from becoming disengaged, and a second, flexed position where it is disengaged from said display floor and allows said partition to move longitudinally and allows said first and second coupling means to become disengaged, wherein said spring finger is an integrally molded part of said partition and includes a trigger part pullable by a user to move said finger from said relaxed to said flexed position.

* * * * *